US006340185B1

(12) United States Patent
Truong

(10) Patent No.: US 6,340,185 B1
(45) Date of Patent: Jan. 22, 2002

(54) MULTI-POSITIONAL ADVANCED DOOR SECURITY LOCK

(75) Inventor: David Truong, San Jose, CA (US)

(73) Assignee: International Business and Technology Corporation, San Jose, CA (US)

( * ) Notice: Subject to any disclaimer, the term of this patent is extended or adjusted under 35 U.S.C. 154(b) by 0 days.

(21) Appl. No.: 09/305,154

(22) Filed: May 4, 1999

Related U.S. Application Data

(63) Continuation-in-part of application No. 09/286,134, filed on Apr. 1, 1999.

(51) Int. Cl.[7] ..... E05C 17/54

(52) U.S. Cl. ..... 292/339; 292/262; 292/DIG. 15; 16/82

(58) Field of Search ..... 292/202, 265, 292/267, 269, 278, 262, 338, 339, DIG. 15, 342; 16/82; 403/379.5, 376, 378

(56) References Cited

U.S. PATENT DOCUMENTS

| | | | | | |
|---|---|---|---|---|---|
| 866,881 | A | | 11/1907 | Parker et al. | |
| 1,002,812 | A | | 8/1911 | Moore | |
| 1,505,184 | A | | 8/1924 | Zukor | |
| 1,606,084 | A | * | 11/1926 | Kline | 292/338 |
| 1,851,612 | A | * | 3/1932 | Werth | 292/338 |
| 3,143,369 | A | | 8/1964 | Adams | |
| 3,399,918 | A | * | 9/1968 | Nagy | 292/136 |
| 3,480,247 | A | | 11/1969 | Waner | |
| 3,633,862 | A | | 1/1972 | Breen | |
| 3,690,709 | A | * | 9/1972 | Bogusz | 292/262 |
| 4,215,885 | A | | 8/1980 | McCray | |
| 4,738,151 | A | * | 4/1988 | Russell | 403/479 |
| 5,071,099 | A | | 12/1991 | Kuo | |
| 5,112,023 | A | | 5/1992 | Sowers | |
| 5,232,225 | A | | 8/1993 | Palmer et al. | |
| 5,490,304 | A | * | 2/1996 | Winner | 16/82 |
| 5,676,410 | A | * | 10/1997 | Angerbrandt | 292/338 |
| 5,703,735 | A | | 12/1997 | Bleek | |
| 5,727,822 | A | | 3/1998 | Troung | |
| 5,771,533 | A | * | 6/1998 | Kuang-Pin | 16/82 |
| 5,826,850 | A | | 10/1998 | Goldsmith | |
| 5,836,049 | A | * | 11/1998 | Chiang | 16/82 |

FOREIGN PATENT DOCUMENTS

| | | | | |
|---|---|---|---|---|
| FR | 630304 | * | 12/1927 | 292/338 |

* cited by examiner

*Primary Examiner*—Gary W. Estremsky
(74) *Attorney, Agent, or Firm*—Beyer Weaver & Thomas, LLP

(57) ABSTRACT

The invention relates to an apparatus for holding a door. The apparatus includes a door mounting plate configured to be mounted on the door. The door mounting plate is arranged to extend perpendicularly from the door and includes a door binding portion. The apparatus further includes a rigid body member arranged to be coupled to a floor and to extend perpendicularly from the floor wherein the body member is substantially immovable by a force exerted by the door. The apparatus additionally includes a locking member coupled to the body member. The locking member is disposed substantially perpendicular to the body member and has a locking member binding end configured to engage with the door binding portion.

22 Claims, 15 Drawing Sheets

MULTI-POSITIONAL ADVANCED DOOR SECURITY LOCK

CROSS REFERENCE TO RELATED APPLICATION

The present application is a Continuation-In-Part of U.S. patent application titled, "An Advanced Door Security Lock", U.S. patent Ser. No. 09/286,134, filed Apr. 1, 1999, which is incorporated herein by reference in its entirety for all purposes.

BACKGROUND OF THE INVENTION

The present invention relates to methods and apparatus for use in home and office security. More particularly methods and apparatus for securely keeping a door from being forcibly broken down, both while it is closed and while it is partially open, are disclosed.

Crime rates, particularly rates pertaining to home-invasion crimes, are on the rise. As such, the issue of home security is of considerable concern to many people. Since a substantial percentage of home-invasion crimes begin with the act of a door being broken down, specialized door security devices have been developed to prevent doors from being broken down from the outside.

Although existing door security devices in the market today have been shown to be effective in preventing doors from being broken down from the outside when the door is completely closed, these existing devices are not particularly effective at securing the door in its partially open state, e.g., when the occupant desires to open the door partially to identify the caller, to receive mail or packages, to allow in pets, or the like.

Many existing door security devices are designed to be mounted to a portion of the floor on one side of a door. Such devices are often secured by a base portion that requires a portion of the floor to be "drilled out" or otherwise removed such that the base of a door security device may be mounted in the base portion. Further, many base portions may prove to be an obstacle when the corresponding door security devices are not in use. For instance, a base portion may catch the heel of a shoe, e.g., a high-heeled shoe, and cause a person wearing the shoe to trip.

In view of the foregoing, what are desired are improved methods and apparatus for securely keeping a door from being forcibly broken down, both in its closed state and in its partially open state. In particular, what are desired are methods and apparatus for securely keeping a door from being forcibly broken down, without providing an obtrusive obstacle while the apparatus is not in use.

SUMMARY OF THE INVENTION

The invention relates, in one embodiment to an apparatus for holding a door. The apparatus includes a door mounting plate configured to be mounted on the door. The door mounting plate is arranged to extend perpendicularly from the door and includes a door binding portion. The apparatus further includes a rigid body member arranged to be coupled to a floor and to extend perpendicularly from the floor wherein the body member is substantially immovable by a force exerted by the door. The apparatus additionally includes a locling member coupled to the body member. The locking member is disposed substantially perpendicular to the body member and has a locking member binding end configured to engage with the door binding portion.

The invention relates, in another embodiment to an apparatus for holding a door. The apparatus includes a door mounting plate configured to be mounted on the door. The door mounting plate is arranged to extend perpendicularly from the door and includes a door binding portion. The apparatus further includes a rigid body member arranged to be coupled to a floor and to extend perpendicularly from the floor wherein the body member is substantially immovable by a force exerted by the door. The apparatus additionally includes a locking member slidably coupled to the body member. The locking member is disposed substantially perpendicular to the body member and has a locking member binding end configured to couple with the door binding portion.

The invention relates, in another embodiment, to an apparatus for holding a door. The apparatus includes a door mounting plate configured to be mounted on the door. The door mounting plate is arranged to extend perpendicularly from the door and includes a door binding portion. The apparatus further includes a rigid body member arranged to be coupled to a floor and to extend perpendicularly from the floor wherein the body member is substantially immovable by a force exerted by the door. The apparatus additionally includes a locking member coupled to the body member. The locking member is disposed substantially perpendicular to the body member and has a locking member binding portion configured to couple with the door binding portion. The apparatus also includes a collar configured to be coupled to the door binding portion and the locking member binding portion wherein the collar prevents the door binding portion from being de-coupled from the locking member binding portion when the collar is coupled to both the door binding portion and the locking member binding portion.

The invention relates, in another embodiment, to an apparatus for preventing a door from being forcibly opened from either a first predefined position or a second predefined position, the door being opened further in the second predefined position than in the first predefined position. The apparatus includes a door mounting plate configured to be mounted on the door. The door mounting plate is arranged to extend perpendicularly from the door and includes a door binding portion. The apparatus further includes a rigid body member arranged to be coupled to a floor and to extend perpendicularly from the floor wherein the body member is substantially immovable by a force exerted by the door. The apparatus additionally includes a locking member slidably coupled to the body member. The locking member is disposed substantially perpendicular to the body member and has a locking member binding end configured to couple with the door binding portion. The apparatus further includes a floor mounting plate configured to be mounted on the floor. The floor mounting plate includes a recess for rotatably coupling the body member to the floor mounting plate such that when the body member is rotated to a position where the locking member is substantially parallel to the door, the locking member and the body member are in a door blocking position. The apparatus also includes a stop arrangement configured to hold the locking member in a predetermined position relative to the body member such that the holding prevents the door from moving past one of the predefined door positions when the binding portion is bound.

The invention relates, in yet another embodiment, to an apparatus for preventing a door from being forcibly opened from either a first predefined position or a second predefined position, the door being opened further in the second predefined position than in the first predefined position. The apparatus including a door mounting plate configured to be mounted on the door. The door mounting plate being arranged to extend perpendicularly from the door. The apparatus further includes a locking member coupled to the door mounting plate. The locking member having a locking member binding end. The apparatus additionally includes a body member arranged to be coupled to a floor and to extend perpendicularly from the floor. The body member including a body binding portion configured to hold the locking member binding end to the body member such that the holding prevents the door from moving past one of the predefined door positions when the binding portion is bound.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be obvious, however, to one skilled in the art, that the present invention may be practiced without some or all of these specific details. In other instances, well known structures and process steps have not been described in detail in order not to unnecessarily obscure the present invention.

Figure 1:
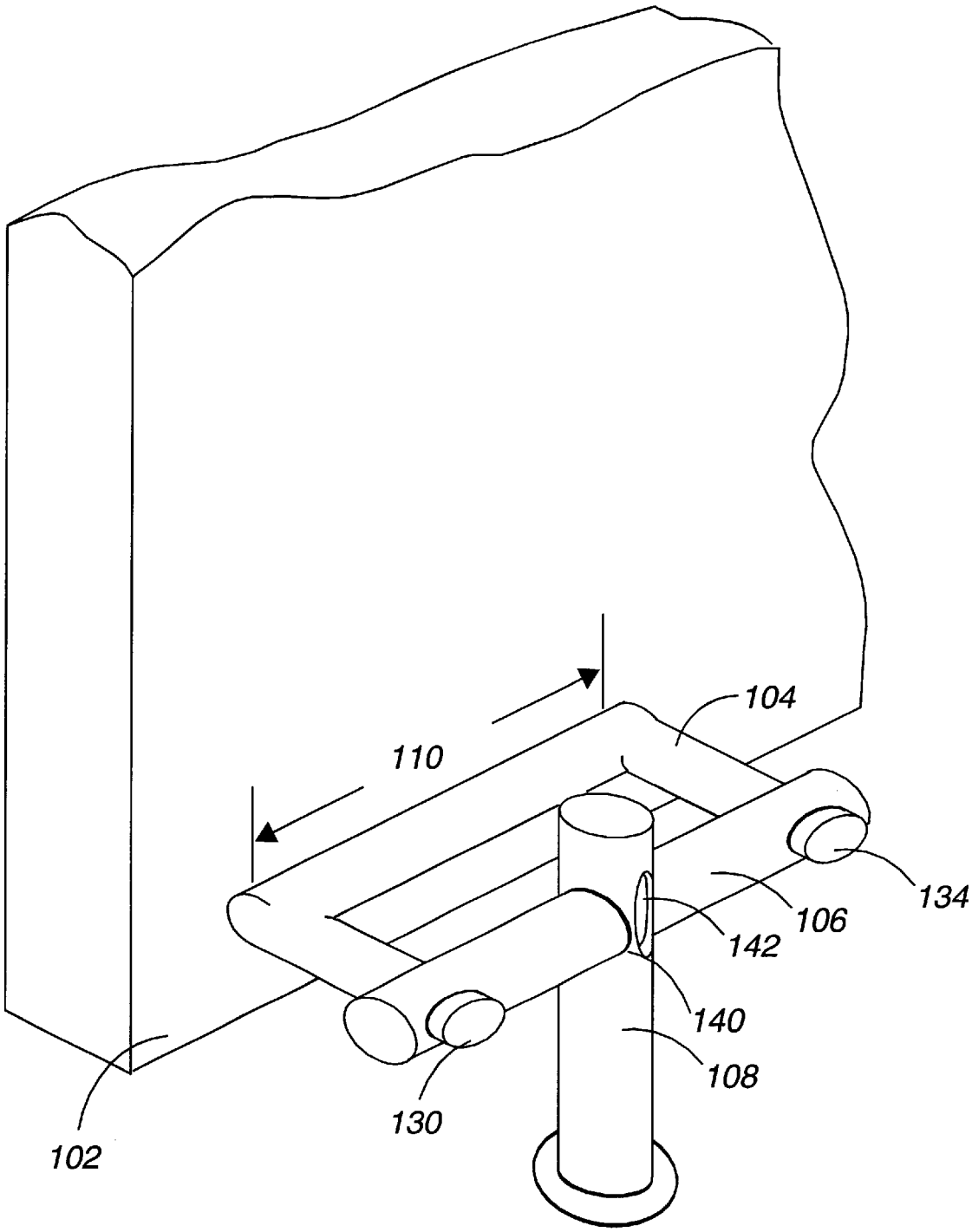
FIG. 1 is an illustration of an Advanced Door Security lock in accordance with a preferred embodiment of the present invention.

Referring initially to FIG. 1, there is shown an Advanced Door Security (ADS) lock in accordance with a preferred embodiment of the present invention. The ADS lock comprises a lock-arm 104, a bar 106, and a body member 108. Lock-arm 104 is mechanically coupled to bar 106, and the combination of lock-arm 104 and bar 106 forms what will herein be referred to as a blocking member. The blocking member is rotatably coupled to body member 108. In this embodiment, the blocking member is comprised of lock-arm 104 and bar 106, which are formed as individual pieces. However, in general, the blocking member may be made up of only one piece, i.e., lock-arm 104 and bar 106 may be formed as a single part.

In order for the ADS lock to secure a door, the ADS lock must is mounted to a floor, or a similar surface, at the foot of a door such that when an attempt is made at opening the door, the door contacts the ADS lock. In some cases, the ADS lock may be mounted directly into the floor. In others, body member 108 may be mounted in a receptacle which may be attached to the floor using mechanical screws or an adhesive. The receptacle may also include holes or a sleeve to physically support body member 108.

In this embodiment, body member 108 is mounted vertically in front of a door 102 it is intended to secure. The location of body member 108 is such that when the blocking member of the ADS lock is in a first blocking position, lock-arm 104 makes contact with door 102 to hold it in a first predefined position as shown in FIG. 1. Typically, when door 102 is closed, it is considered to be in the first predefined position although this first predefined position may also represent a slightly open door. The portion of lock-arm 104 which contacts door 102 when the blocking member is in a first blocking position is herein referred to as a blocking edge 110. When body member 108 is positioned in front of door 102, blocking edge 110 is positioned in the first blocking position such that blocking edge 110 comes into contact with door 102 to hold it in the first predefined position. More preferably, blocking edge 110 is in a horizontal position, i.e., it is parallel to the plane of the floor.

The blocking member is rotatably coupled to body member 108 by means of a thru-hole 140 in body member 108 in which bar 106 of the blocking member is placed. Thru-hole 140 should be large enough to accommodate bar 106 and provide enough clearance to allow bar 106 to rotate in thru-hole 140 about its center-line. As bar 106 rotates, due to the fact that lock-arm 104 is mechanically coupled to bar 106, lock-arm 104 and blocking edge 110 also rotate with respect to the center-line of bar 106.

The rotation of bar 106 is preferably mechanically constrained, i.e., bar 106 is free to rotate only within a fixed range. A pin (shown in greater detail in subsequent FIGS. 2 and 3) is inserted into bar 106 through a thru-slot 142 in body member 108. The pin rotates within thru-slot 142 and serves to constrain the rotation of bar 106. Rotation is constrained when the pin reaches the bottom of thru-slot 142, thereby holding the blocking member at either the first blocking position or the second blocking position.

In one embodiment, when the blocking member is in the second blocking position, ends 130 and 134 of lock-arm 104 make contact with door 102 to hold it at a second predefined position. In some cases, depending upon the dimensions of body member 108, body member 108 may come into contact with door 102 to furnish a third point of contact to more securely hold door 102 in the second predefined position.

The second blocking position of the blocking member holds door 102 in the second predefined position, which is generally a position in which door 102 is opened wider than it is when it is in a first predefined position. By way of example, in some embodiments, the first predefined position will be when door 102 is closed, and the second predefined position will be when door 102 is open approximately 2.5 inches. In others, the blocking member is preferably dimensioned such that second predefined position is reached when door 102 is open approximately 3 feet, e.g., enough to allow a single person to enter as in crowd control applications. In general, the second blocking position may be reached by rotating the body member away from the first blocking position. More preferably, the blocking member is placed at the second blocking position by rotating it 180 degrees from the first blocking position, e.g., by flip it around the axis of bar 106.

Alternatively, it is contemplated that the blocking member, when in the first blocking position, is disposed such that its plane is substantially parallel to the ground and points toward the door, i.e., its blocking edge is closer to the door than the bar. In the second blocking position, the blocking member may be mechanically constrained at a slight angle, preferably pointing toward the door, to permit the door to be slightly open. The angle may be either upward or downward. Further, it is contemplated that mechanical devices, e.g., a spring, may be provided to help the blocking member to return to the first blocking position from the second blocking position.

Figure 2:
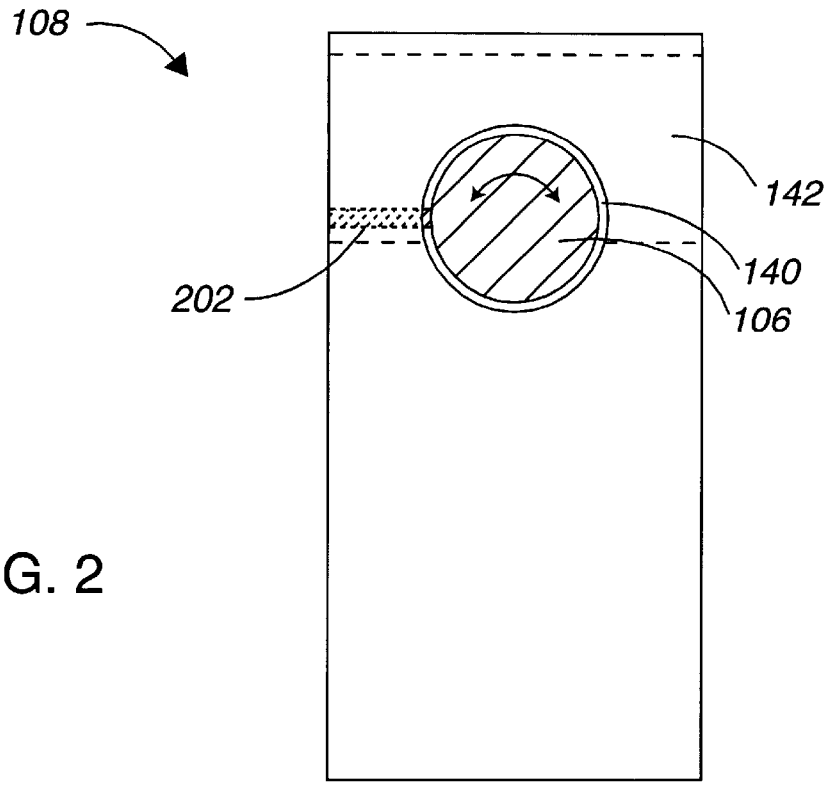
FIG. 2 is a cross-sectional illustration of a first configuration of the body member of an Advanced Door Security lock in accordance with a preferred embodiment of the present invention.

Referring next to FIG. 2, a cross-sectional illustration of a configuration of aforementioned body member 108 will be described in detail. As previously mentioned with respect to FIG. 1, thru-hole 140 in body member 108 serves to hold bar 106 while enabling the bar to rotate about its center-line. Bar 106 contains a pin 202 which rotates in thru-slot 142 with bar 106 (and constrained when pin 202 reaches the bottom of thru-slot 142. In this configuration, bar 106 and the lock-arm, e.g. bar 106 and lock arm 104 of FIG. 1, which comprise the blocking member as previously described must be made of more than one piece to enable bar 106 to be inserted through the thru-hole 140.

Figure 3:
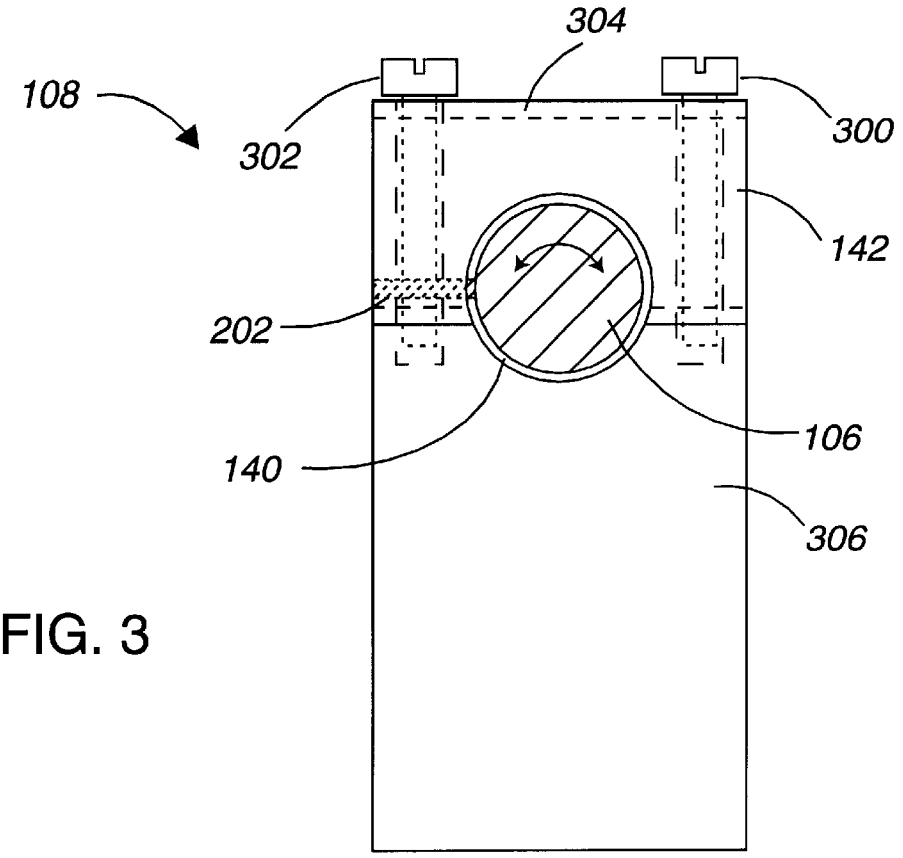
FIG. 3 is a cross-sectional illustration of a second configuration of the body member of an Advanced Door Security lock in accordance with a preferred embodiment of the present invention.

FIG. 3 is a cross-sectional illustration of another configuration of body member 108. In this configuration, body member 108 is comprised of two pieces, a body stem 306 and a body cap 304, which are held together with fasteners 300 and 302. Fasteners 300 and 302 may represent, for example, screws or the like. Pin 202 and thru-slot 142 are again shown. As described with respect to FIG. 2, thru-hole 140 in body member 108 serves to hold bar 106 which, in turn, contains pin 202. As previously mentioned, pin 202 rotates in thru-slot 142 while bar 106 rotates about its center-line. In this configuration, the lock-arm, as for example lock-arm 104 as described with reference to FIG. 1, and bar 106 are not required to be constructed of more than one piece. The fact that body member 108 is comprised of body stem 306 and body cap 304 makes it possible for a one-piece blocking member to be placed in thru-hole 140.

Figure 4:
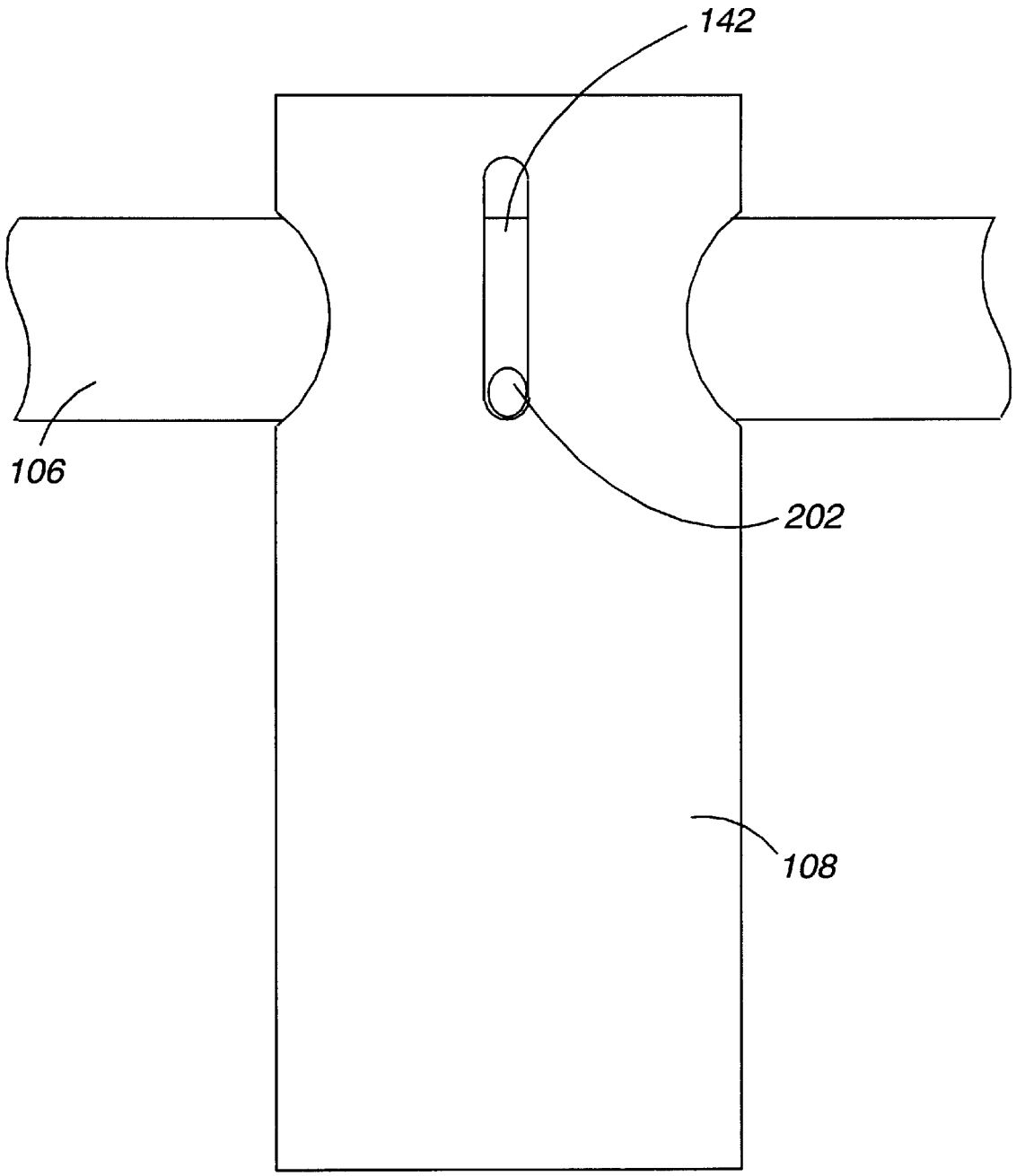
FIG. 4 is an illustration of the body member of an Advanced Door Security lock shown with the mechanism which constrains the rotation of the bar and the blocking member of the Advanced Door Security lock in accordance with a preferred embodiment of the present invention.

Referring next to FIG. 4, the mechanism which serves to constrain rotation of bar 106 (and concomitantly of the blocking member) will be explained in detail. FIG. 4 is an illustration of body member 108, which is shown as being of a one-piece construction, although it may also be comprised of two pieces as described above with reference to FIG. 3. Bar 106 contains pin 202 which rotates in thru-slot 142 and serves to constrain the rotation of bar 106 as it rotates about its center-line. When pin 202 comes to rest at the bottom of thru-slot 142, as shown, bar 106 is constrained from rotating any further in the direction it was rotating when pin 202 came to a rest. It should be clear that thru slot 142 extends through the bar; as such, pin 202 may come to rest in two positions, the position as shown in FIG. 4, and a position on the other side of body member 108.

Figure 5:
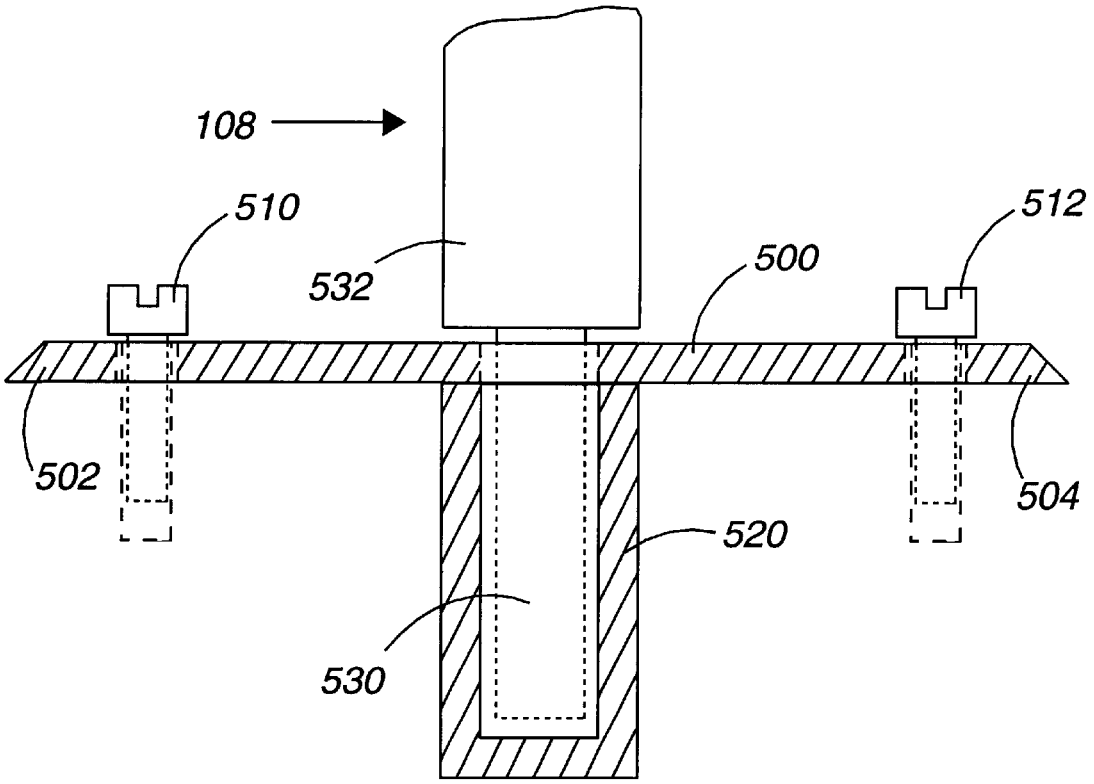
FIG. 5 is a cross-sectional illustration of a receptacle which is used to support an Advanced Door Security lock in accordance with a preferred embodiment of the present invention.

FIG. 5 is a cross-sectional illustration of a receptacle which may be used to support body member 108 of the ADS lock to more securely hold the ADS lock to the floor. Body member 108, as shown in FIG. 5, is a rod comprised of sections 532 and 530 which may have different diameters. The receptacle is comprised of a plate 500 which is mounted on a floor or similar surface to support body member 108. Plate 500 has a portion 520, e.g., a sleeve or a closed-end tube, which may be embedded into an opening in the floor and serves to more securely hold section 530 of body member 108. Alternatively, portion 520 may be integral with the plate, i.e., the sleeve or the closed-end tube is self-contained within the plate, so no alteration or drilling of the floor is necessary. This embodiment is highly advantageous in situations where it is not possible or desirable to create a hole in the floor to accommodate a portion 520 that is in the floor. To further reduce the alteration to the floor, the plate may be attached to the floor using, for example, an appropriate adhesive. Plate 500 may also have tapered edges 502 and 504, which serve to create a smooth transition between the boundary of plate 500 and the floor. Either an adhesive or fasteners 510 and 512, e.g., screws or the like, may be used to secure plate 500 to the floor.

Figure 6:
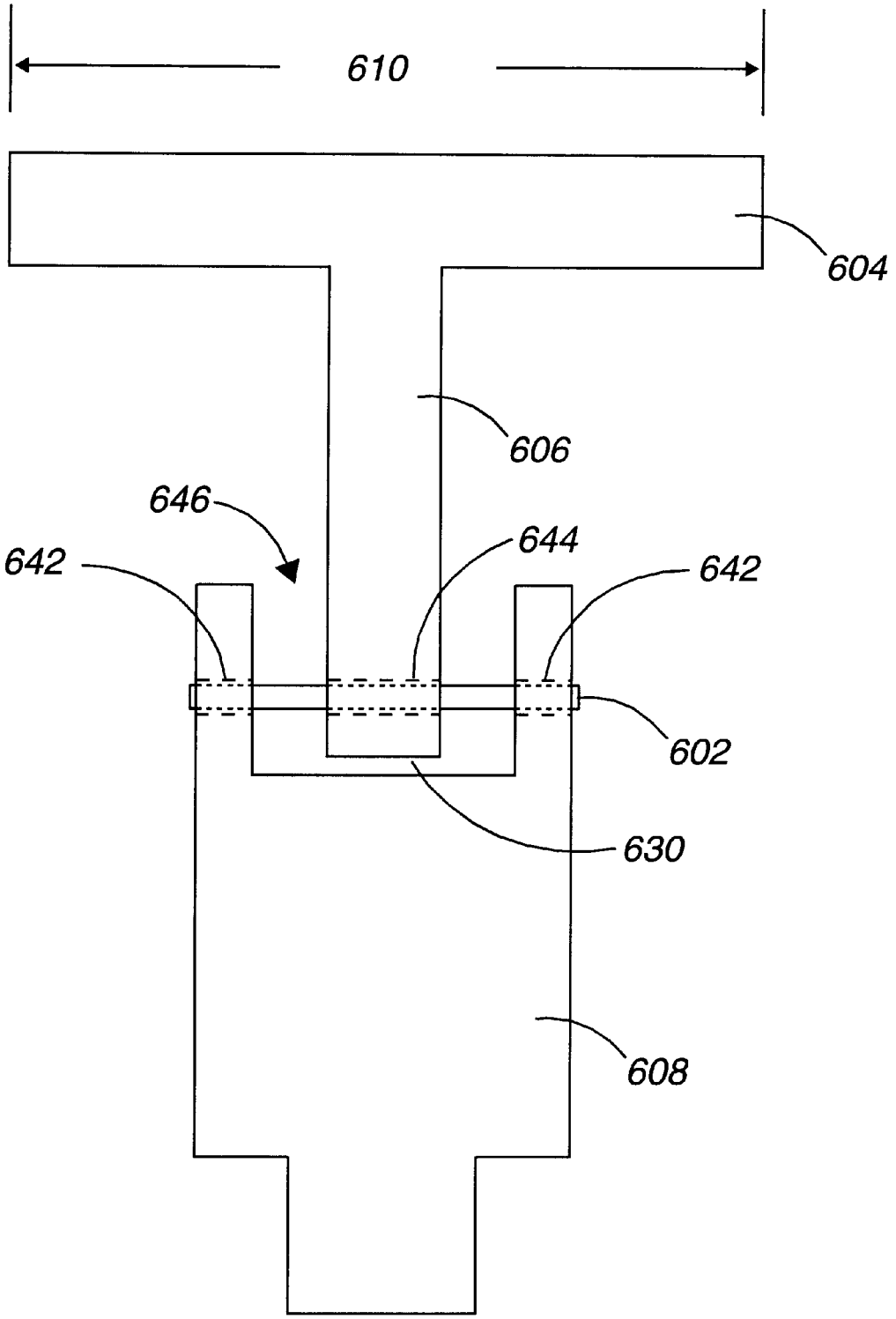
FIG. 6 is a cross-sectional illustration of an Advanced Door Security lock in accordance with a second preferred embodiment of the present invention.

Referring next to FIG. 6, there is shown a cross-sectional illustration of an ADS lock in accordance with another preferred embodiment of the present invention. The ADS lock of this embodiment comprises a lock-arm 604, a bar 606, and a body member 608. Lock-arm 604 is analogous in function to lock-arm 104 of the previous embodiment. Similarly, bar 606 and body member 608 are analogous in function to bar 106 and body member 108, respectively, as shown in FIG. 1. As before, the combination of lock-arm 104 and bar 106 comprises a blocking member. The blocking member as shown in FIG. 6 is shaped like the letter "T." The blocking member is rotatably coupled to body member 608. In this embodiment, the blocking member is comprised of one piece, although lock-arm 604 and bar 606 may be separate elements which are mechanically coupled. A blocking edge 610, analogous in function to blocking edge 110, comes into contact with a door to hold it in a first predefined position.

To hold the door in a second predefined position, the blocking member is preferably rotated such that an end 630 of bar 606 contacts the door. End 630 is analogous in function to ends 130 and 134 as described with reference to FIG. 1, contacts the door. A pin 602 passes through a thru-slot 642 which extends through body member 608 to hold the blocking member while enabling it to rotate. The arch through which the blocking member may rotate is constrained by a notch 646 in the body member 608. When bar 606 contacts the bottom of notch 646 in body member 608, the blocking member is stopped from rotating any further in the direction in which it was rotating when contact was made.

As described above, a receptacle may be used to support a body member of an ADS lock. The receptacle depicted in FIG. 5 includes a plate and a portion that is arranged to be embedded into an opening in a floor. Although such a receptacle is generally effective in supporting the body member of an ADS lock, such a receptacle typically requires that a portion of a floor be bored, or otherwise hollowed, out to house the receptacle. In some situations, hollowing out a floor for more than screw holes may prove to be undesirable. By way of example, if the receptacle is to be moved from a first position to a second position, a portion of the floor will typically be bored out for each receptacle position. The bored out portion associated with the first position may then cause an obstacle to individuals walking on the floor, e.g., the heel of a person's shoe may be caught in the bored out portion. In addition, the portion of the receptacle that is embedded in the floor may prove to be an obstacle as well.

Figure 7:
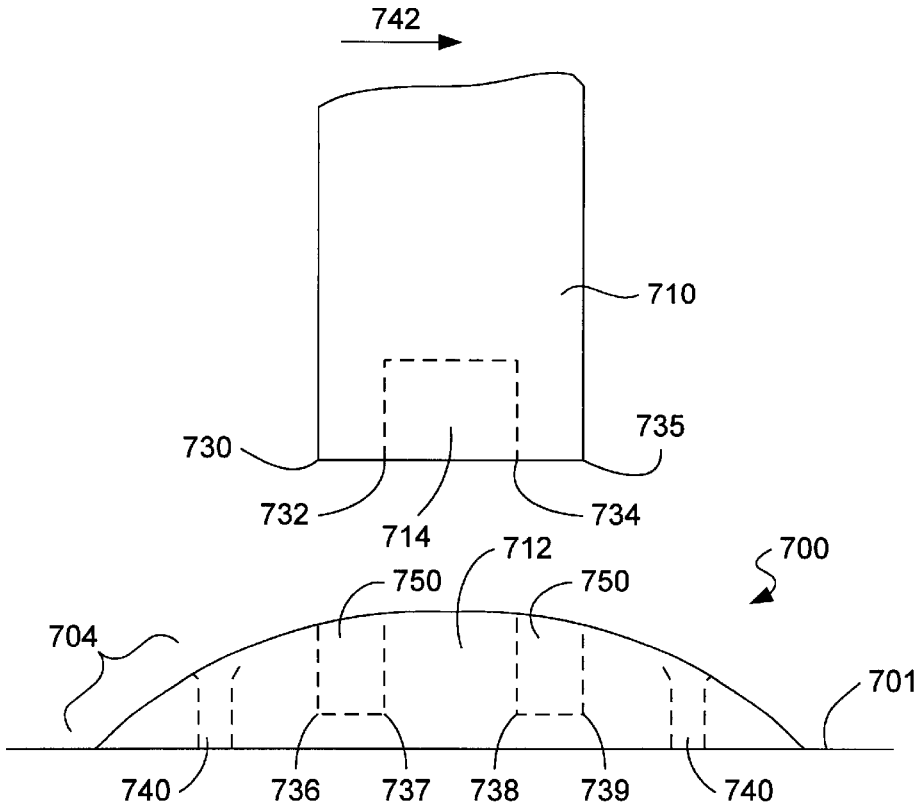
FIG. 7 is a diagrammatic cross-sectional side-view representation of a portion of a body member of an Advanced Door Security lock and a base plate in accordance with a third preferred embodiment of the present invention.

It should be appreciated that the design of a receptacle may generally be widely varied. FIG. 7 is a diagrammatic cross-sectional side-view representation of a portion of a body member, or a post, of an ADS lock and a receptacle, or a base plate, for supporting the ADS lock in accordance with a third embodiment of the present invention. A base plate 700, i.e., a mounting plate, is arranged such that substantially no portion of base plate 700 penetrates a surface 701, e.g., a surface of a floor, when base plate 700 is fixed with respect to surface 700. Since substantially no portion of base plate 700 penetrates surface 701, base plate 700 may be moved relatively easily to different surfaces, as portions of surfaces generally need not be bored out in order to receive portions of base plate 700. In addition to being more portable than a receptacle which is at least partially mounted in a floor, by not requiring the floor to be bored out, the use of base plate 700 reduces the potential disfacement, or marring, of surface 701.

Further, since base plate 700 does not include a relatively large opening that extends below surface 701, into which a body member is to be inserted, it is less likely that a person wearing a high-heeled shoe will get her heel caught in the opening. Hence, base plate 700 may generally be less of an obstacle than, for example, plate 500 of FIG. 5.

Base plate 700 has a sloped profile, as indicated by a slope 704. While slope 704 may vary, slope 704 is arranged such that base plate 700 is not likely to be tripped over by an individual walking over base plate 700. Since the likelihood of an individual walking over base plate 700 is fairly high, due to the fact that base plate 700 is typically mounted near a door, choosing slope 704 such that base plate 700 has a relatively low profile may prevent accidents.

A body member 710, referred to herein as a post, is arranged to be inserted over a protrusion 712 of base plate 700. Protrusion 712 extends above a bottom surface of base plate 700, i.e., the surface of base plate 700 which is arranged to interface with surface 701, and is arranged to engage a cavity 714 defined in body member 710. Specifically, as shown, protrusion 712 and cavity 714 are arranged to cooperate to support post 710 within respect to base plate 700.

As will be understood by those skilled in the art, a higher aspect ratio, or ratio of height to width, of a hole used to support post 710 increases the rigidity associated with supporting post 710. Increasing the rigidity, in turn, serves to increase the overall effectiveness of an ADS lock that includes post 710. Protrusion 712 increases the aspect ratio associated with base plate 700 over the aspect ratio of a similar base plate with no protrusion.

A channel 750 surrounds protrusion 712 and is arranged to contact post 710. Channel 750 includes a portion 736, a portion 737, a portion 738, and a portion 739. Portion 736 is arranged to contact a portion 730 of post 710 when post 710 is inserted in base plate 700. Similarly, a portion 732 of post 710 is arranged to contact portion 737, a portion 734 of post 710 is arranged to contact portion 738, and a portion 735 is arranged to contact portion 739, when post 710 is inserted in base plate 700. The contact between the various portions of post 710 and base plate 700 serves to keep post 710 positioned within base plate 700. In addition, the contact between the different portions increases the amount of force necessary, over the force needed without the use of protrusion 712 and channel 750, to dislodge post 710 from base plate 700 when a force is applied against post 710. Specifically, the contact between portion 730 and portion 736 as well as the contact between portion 734 and portion 738 increases the magnitude of the force necessary in an axial direction 742 to dislodge post 710. Likewise, the contact between portion 732 and portion 737 as well as the contact between portion 735 and portion 739 increases the magnitude of the force necessary in the opposite direction from axial direction 742 to dislodge post 710. That is, the security and stability of post 710 with respect to base plate 700 is enhanced with the "four-point contact" between post 710 and base plate 700.

The size of protrusion 712 and, hence, channel 750 may vary widely. However, in the described embodiment, the dimensions of channel 750 and protrusion 712 in axial direction 742 are chosen such that, together, they are substantially equal to the axial dimension of post 710. In addition, the dimension of channel 750 in axial direction 742, i.e., the width of channel 750, is typically chosen to be narrow enough to prevent the heel of a high-heeled shoe from catching channel 750 or otherwise becoming lodged in channel 750. Since base plate 700 is typically located at or close to a door in a doorway, individuals will typically walk over or on base plate 700. Therefore, preventing heels from being caught in base plate 700 is likely to prevent injuries to individuals.

Thru-holes 740 are arranged such that screws (not shown) may be used to fasten base plate 700 to surface 701. Although four thru-holes 740 have been shown, it should be appreciated that the number, as well as the location, of thru-holes 740 may be widely varied. In one embodiment, thru-holes 740 are counter bored, or counter sunk, to prevent screw heads used to mount base plate 700 to surface 701 from protruding past the top surface of base plate 700. That is, thru-holes 740 may be counter bored to prevent screw heads from providing an obstacle over which an individual may trip.

Figure 8:
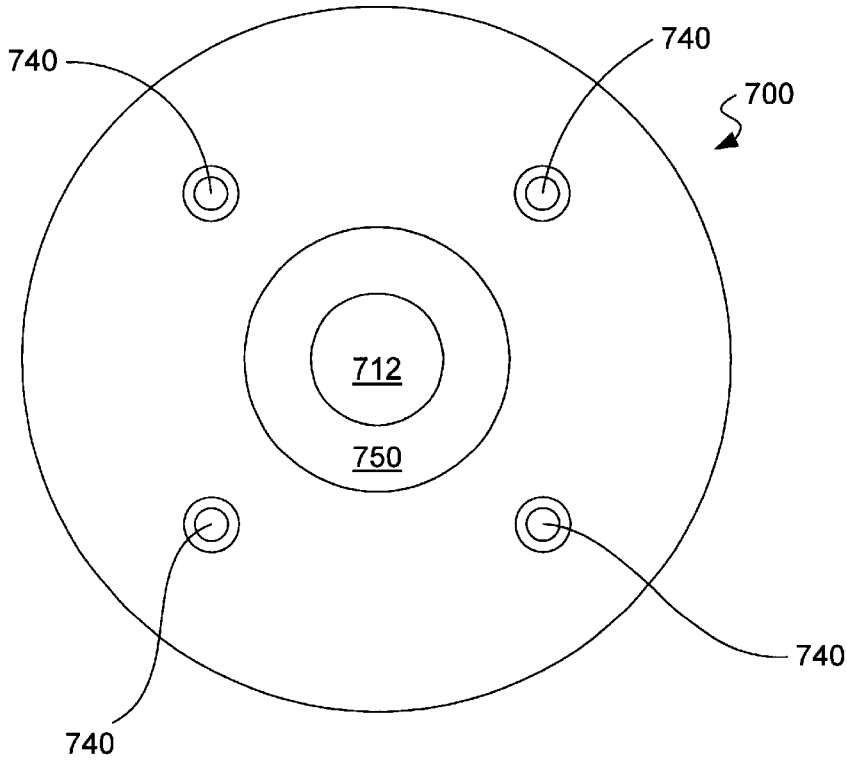
FIG. 8 is a diagrammatic top-view representation of the base plate of FIG. 7 in accordance with the third preferred embodiment of the present invention.

FIG. 8 is a diagrammatic top-view representation of base plate 700. As shown, base plate 700 has a substantially circular shape, and thru-holes 740 are substantially evenly spaced with respect to protrusion 712. It should be appreciated that for ease of illustration, the components of base plate 700 have not necessarily been shown to scale.

In general, base plate 700 is formed from a material that is relatively resistant to wear and tear. Preferably, base plate 700 is formed from a rigid material such as a metal or a metal alloy. In one embodiment, base plate 700 may be formed from stainless steel. Alternatively, other materials, which include but are not limited to hard plastics, may be used in the formation of base plate 700.

Figure 9:
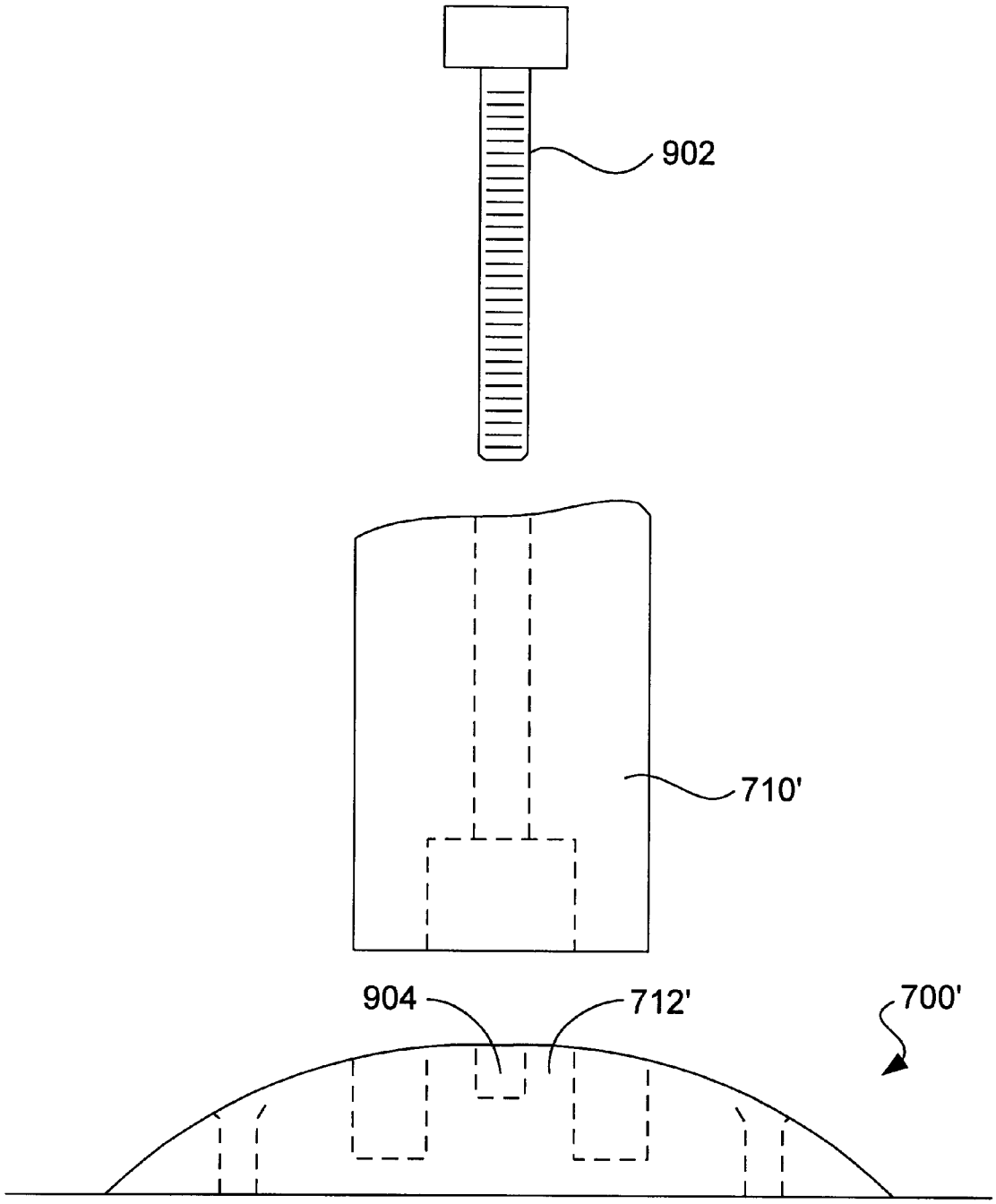
FIG. 9 is a diagrammatic cross-sectional side-view representation of a base plate arranged for use with a securing mechanism and a portion of a body member of an Advanced Door Security lock, also as arranged for use with a securing mechanism, in accordance with a fourth preferred embodiment of the present invention.

Referring back to FIG. 7, in addition to utilizing protrusion 712 and channel 750 to effectively engage post 710, reinforcing mechanisms may be used to further secure post with respect to base plate 700. In other words, base plate 700 and post 710 may be modified such that an additional securing mechanism may be used to strengthen the coupling between base plate 700 and post 710. While the additional securing mechanism that is used may be widely varied, in one embodiment, the securing mechanism may be a screw 902 designed to pass longitudinally through a post 710' and screw into a threaded opening 904 in a protrusion 712' of a base plate 700', as indicated in FIG. 9.

Figure 10:
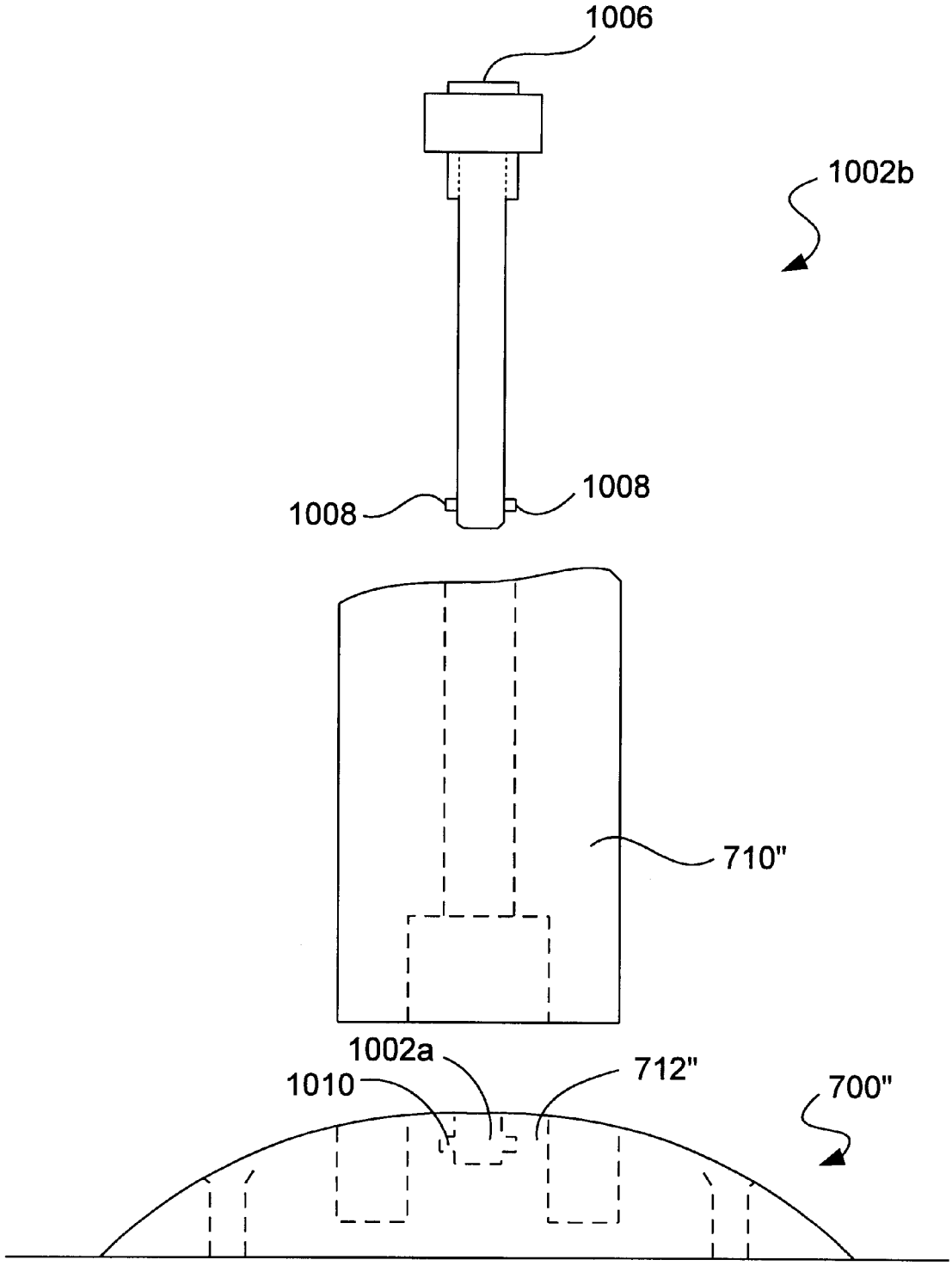
FIG. 10 is a diagrammatic cross-sectional side-view representation of a base plate arranged for use with a securing mechanism and a portion of a body member of an Advanced Door Security lock, also as arranged for use with a securing mechanism, in accordance with a fifth preferred embodiment of the present invention.

In another embodiment, the additional securing mechanism used to strengthen the coupling between a post 710" and a protrusion 712" of a base plate 700"may be a snap lock arrangement 1002, as shown in FIG. 10. Snap lock arrangement 1002 includes a lock receptacle 1002*a* that is embedded with respect to protrusion 712', and a "snap" 1002*b* which is arranged to snap into lock receptacle 1002*a*. Once snap 1002*b* is coupled to lock receptacle 1002*a,* snap 1002*b* may be removed, for instance, by pressing down on a release button 1006 and turning snap 1002*b* with respect to lock receptacle 1002*a,* as will be appreciated by those skilled in the art. Typically, pressing down on release button 1006 will retract balls 1008 which are arranged to fit in grooves 1010 of lock receptacle 1002*a*. Hence, release button 1006 may be used to enable snap 1002*b* to both be placed into and removed from lock receptacle 1002*a*.

In accordance with another aspect of the present invention, the ADS lock is reconfigured to work with both inward and outward swinging doors. In this embodiment, the blocking member is replaced by a locking member that is slidably coupled to the body member. The locking member is configured to have a plurality of locking positions that will lock the door when the door is shut, when the door is partially opened away from the ADS lock or when the door is partially opened towards the ADS lock. Additionally, the locking member is advantageously coupled to the door. By coupling the locking member to the door the unwanted disengagement of an ADS locked door is prevented.

Figures 11A, 11B, 11C, 11D:
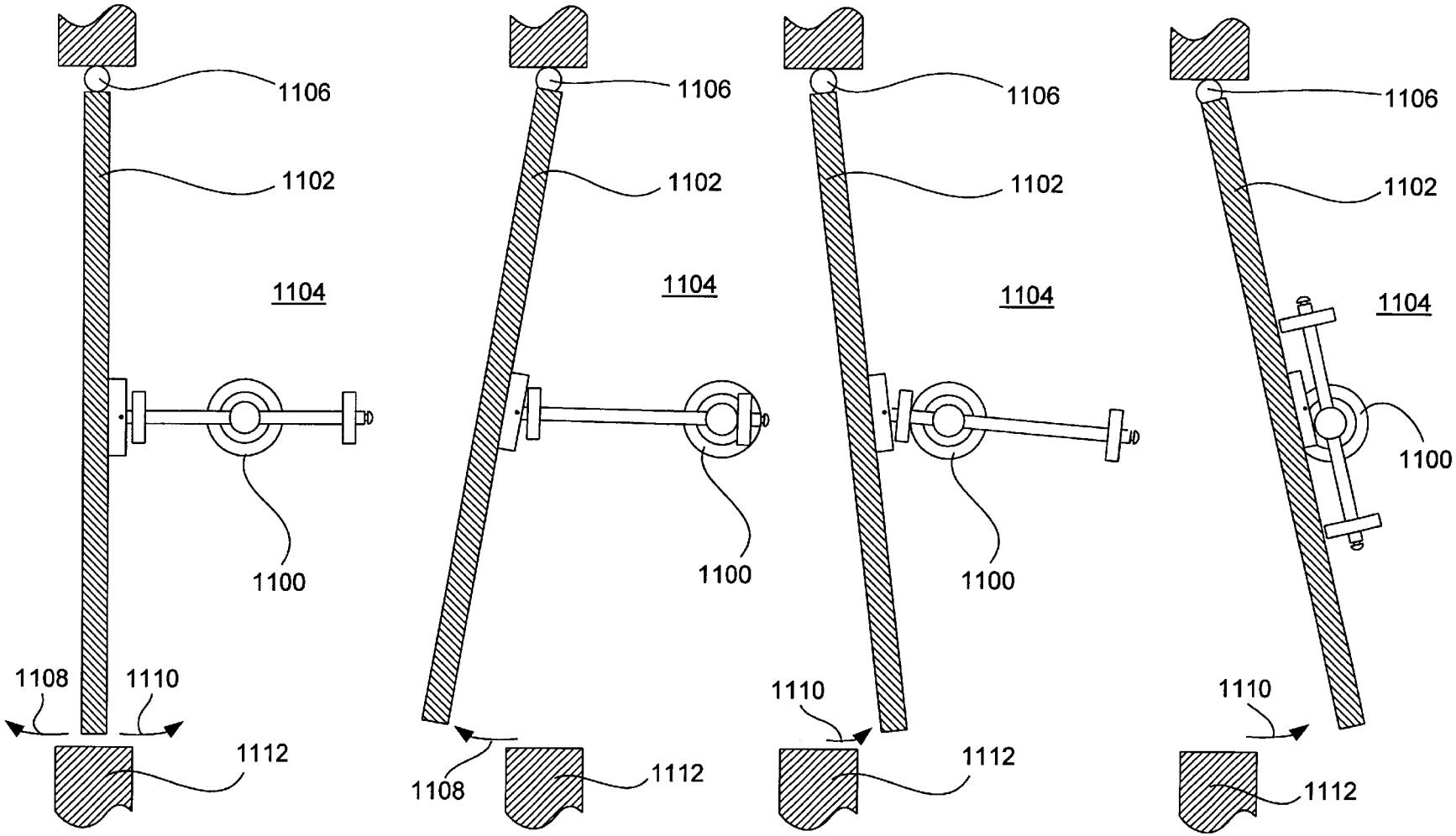
FIGS. 11A–11D show, in accordance with several embodiments of the present invention, a top view of four multi-positional ADS lock arrangements.

Referring to FIGS. 11A–11D, a top view of the multi-positional ADS lock 1100 is shown in multiple arrangements. In all four figures, multi-positional ADS lock 1100 is mounted to a surface 1104, which may be a floor or a ceiling. Typically, door 1102 includes a pivot point 1106 that enables door 1102 to swing along an outside path 1108 and/or an inside path 1110. In FIG. 11A, multi-positional ADS lock 1100 is coupled to door 1102 and is configured to prevent door 1102 from swinging along inside path 1110 and/or outside path 1108. Ideally, this arrangement locks the door in the door shut position wherein the door cannot be pulled or pushed open.

In FIG. 11B, the multi-positional lock is coupled to door 1102 and is configured to prevent door 1102 from swinging in a direction away from the multi-positional ADS lock (e.g., outside swinging door). Basically, the door cannot be pulled past a predefined door position. Ideally, this arrangement provides a small opening between door 1102 and a door frame 1112 wherein select items may be passed from one side of the door to the other or the identity of a person standing outside may be ascertained.

In FIG. 11C, the multi-positional lock is coupled to door 1102 and is configured to prevent door 1102 from swinging in a direction towards the multi-positional ADS lock (e.g., inside swinging door). Basically, the door cannot be pushed past a predefined door position. Ideally, this arrangement provides a small opening between door 1102 and a door frame 1112 wherein select items may be passed from one side of the door to the other or the identity of a person standing outside may be ascertained.

In FIG. 11D, the multi-positional lock is configured to prevent door 1102 from swinging in a direction towards the multi-positional ADS lock (e.g., inside swinging door). In this Figure, the multi-positional ADS lock is not required to be coupled to the door to prevent the door from opening past the location of the multi-positional ADS lock. Basically, the door cannot be pushed past a predefined door position, which is set by the location of the multi-positional ADS lock behind the door. Again, this arrangement provides a small opening between door 1102 and door frame 1112 wherein select items may be passed from one side of the door to the other or the identity of a person standing outside may be ascertained.

Preferably, the opening in FIGS. 11B–11D is configured to be large enough for mail and other similar items and small enough to limit intruder access (e.g., between about 2 to 3 in.). Further, all four positions of the door may be achieved when the multi-positional ADS lock is placed within the confines of the interior of the door, which prevents an intruder from disengaging the multi-positional ADS lock, or even attempting to cut through to gain entry. Also, it is preferable to position the multi-positional ADS lock between the center of the door (as shown) and the outside edge of the door (e.g., edge opposite the door pivot). As is well known in the art, the closer the multi-positional ADS lock is to the outside edge of the door (e.g., near the opening) the stronger the multi-positional ADS lock is in withstanding forces. However, this is not a limitation and any multi-positional ADS lock position that can withstand the forces of an intruder may be used.

Figure 12A:
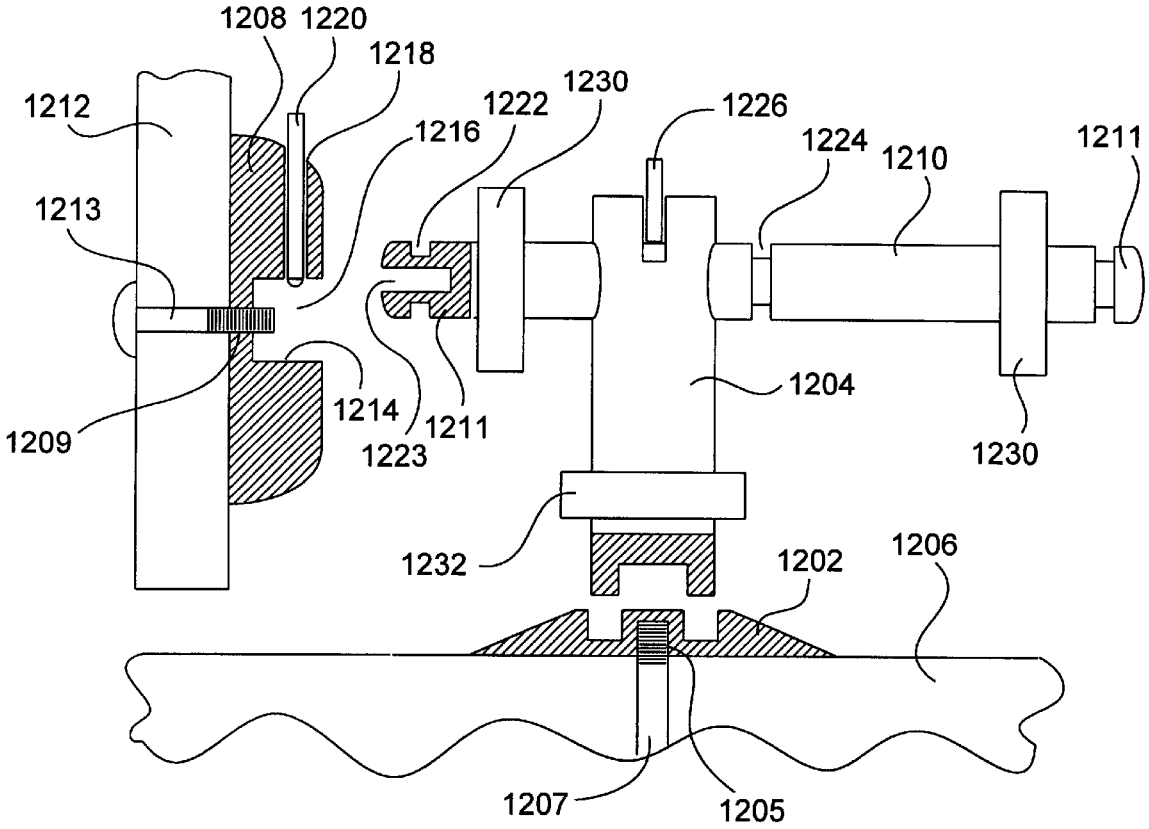
FIGS. 12A & 12B illustrate, in accordance with one embodiment of the present invention, a side view of the multi-positional ADS lock.

To facilitate discussion of the multiple aspects of the present invention, FIG. 12A illustrates a multi-positional ADS lock arrangement 1100 having a floor mounting plate 1202 and a body member 1204. It should be noted that the floor mounting plate may be similar to the previously described base plate. In one embodiment, floor mounting plate 1204 is preferably configured to be mounted to a floor 1206 and includes a recess for receiving body member 1204. In some instances, the floor mounting plate further includes a protrusion disposed inside the recess for additional securement and to prevent objects and shoe heels from being caught inside the recess.

Correspondingly, one end of body member 1204 is configured to cooperate with the recess and/or protrusion of floor mounting plate 1202 such that when the body member is disposed inside the floor mounting plate, the body member is substantially immovable in a lateral direction. In this manner, the body member is substantially coupled to the floor. Preferably, the floor mounting plate and the body member are formed from a material that can withstand the forces of an unwanted intruder (e.g., steel or hard polymer such as plastic). It should be noted that the multi-positional ADS lock arrangement is not limited by the use of a floor mounting plate and that any means suitable for coupling the body member to the floor (e.g., hole in the floor whether or not reinforced with a sleeve) may be used so long as the body member is substantially immovable by a force exerted by an intruder pushing or pulling on a door (e.g., lateral direction).

In one embodiment, the floor mounting plate is configured to include a threaded portion 1205 that coincides with a threaded portion on an anchor bolt 1207 that is fixed in the floor. This arrangement is configured to mount floor mounting plate 1202 to floor 1206. Preferably, the anchor bolt is formed from a material that can withstand the forces of an unwanted intruder (e.g., steel or hard polymer such as plastic). It should be borne in mind that the anchor bolt arrangement is not a limitation and that any means suitable for coupling the floor mounting plate to the floor may be used so long as it is strong enough to withstand the force of an intruder pulling or pushing on a door. In fact, as mentioned in the discussion about the base plate, the floor mounting plate may include a plurality of holes for mounting the floor mounting plate to the floor with screws.

Additionally, multi-positional ADS lock 1100 includes a door mounting plate 1208 and a locking member 1210. Locking member 1210 is slidably coupled to body member 1204. However, it should be noted that the locking member may be coupled in a variety of ways, e.g., structurally coupled, pivotally coupled or rotatably coupled. Typically, locking member 1210 is disposed substantially perpendicular to body member 1204. Although not shown in FIG. 12A, the body member preferably includes a thru-hole that is configured to slidably receive the locking member. Moreover, locking member 1210 further includes a locking member binding end 1211 that is configured to engage door mounting plate 1208. Locking member binding end 1211 includes a binding slot 1222 that is part of a locking mechanism that couples the door mounting plate to the locking member. Optionally, both ends of the locking member may have a locking member binding end. Preferably, locking member 1210 is a rigid member that is formed from a material that can withstand the forces of an unwanted intruder (e.g., steel or hard polymer such as plastic).

Furthermore, door mounting plate 1208 is configured to be mounted to an interior portion of a door 1212 and arranged to extend perpendicularly therefrom. In most instances, door mounting plate 1208 is adjacently coupled to door 1212. In one embodiment, door mounting plate 1208 is configured to include a threaded portion 1209 that coincides with a threaded portion on a bolt 1213. Bolt 1213 is inserted through an aperture in door 1212 and is configured to couple door mounting plate 1208 to door 1212 (as shown in FIG. 12). Preferably, the bolt mounting arrangement prevents an outside intruder from removing the multi-positional ADS lock by placing the securing means inside door 1212. Typically, bolt 1213 connects to thread 1209 in the center of door mounting plate 1208. However, a plurality of bolts and thread locations may be used.

Alternatively, door mounting plate 1208 may be attached to door 1212 by screws that pass through the door mounting plate 1208 into door 1212 such that the screws are completely inaccessible from outside. Additionally, the door mounting plate may be mounted to the door by a plurality of bolts that are structurally coupled to an exterior plate that is located outside of the door. Typically, the bolts pass through a plurality of apertures in the door and are fastened to the door mounting plate. Preferably, the bolts are fastened with coinciding nuts located inside the door (e.g., so that an intruder cannot remove).

Figure 12B:
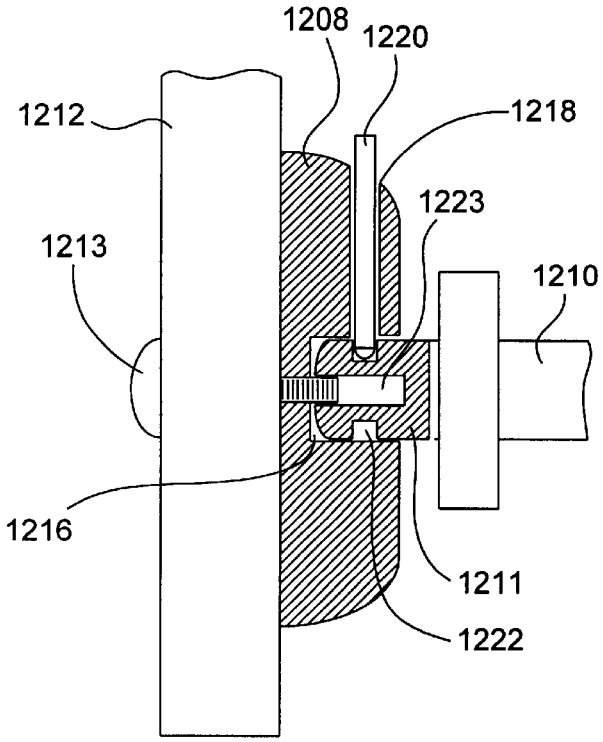

In a preferred embodiment, the door mounting plate is configured to couple to the locking member binding end. Referring to FIG. 12B, door mounting plate 1208 includes a door binding portion 1214 that is used to temporarily couple locking member 1210 to door mounting plate 1208. Preferably, door binding portion 1214 includes an opening 1216 that is configured to receive the locking member binding end. Typically, opening 1216 has a shape that coincides with the cross sectional shape of locking member binding end 1211. In this manner, a portion of the locking member binding end may be disposed inside opening 1216 of door binding portion 1214.

Furthermore, door binding portion 1214 includes a cavity 1218 for slidably holding a pin 1220. Cavity 1218 runs parallel to the surface of the door (as shown in FIG. 12B) from an outer peripheral surface of the door mounting plate to opening 1216. Preferably, pin 1220 is configured to coincide with binding slot 1222 of the locking member binding end. In this manner, the pin may be disposed inside the binding slot when the locking member binding end is positioned in the opening of the door binding portion. Preferably, the pin and binding slot engagement couples the locking member to the door mounting plate. Additionally, the pin advantageously creates a pivot point between the door mounting plate and the locking member that allows some play when the multi-positional ADS lock is moved to one of its locking positions.

In one embodiment, pin 1220 is spring biased towards the center of door mounting plate 1208, thereby automatically engaging the binding slot, when the binding slot is aligned with the pin. In this manner, the user is able to easily connect the locking member to the door mounting plate. To disengage the pin, a user would have to pull against the spring bias as the locking member is pulled away from the opening. Additionally, locking member binding end 1211 may include a binding end opening 1223 for accepting at least a portion of bolt 1213, when the door binding portion is engaged with the locking member binding end. In this manner, the binding linkage is further secured from lateral disengagement. It should be noted that the pin and binding slot combination is not a limitation and that any suitable locking mechanism that can couple the door mounting plate to the locking member may be used (i.e., clamps, threads, spring locks, etc.).

Figure 13A:
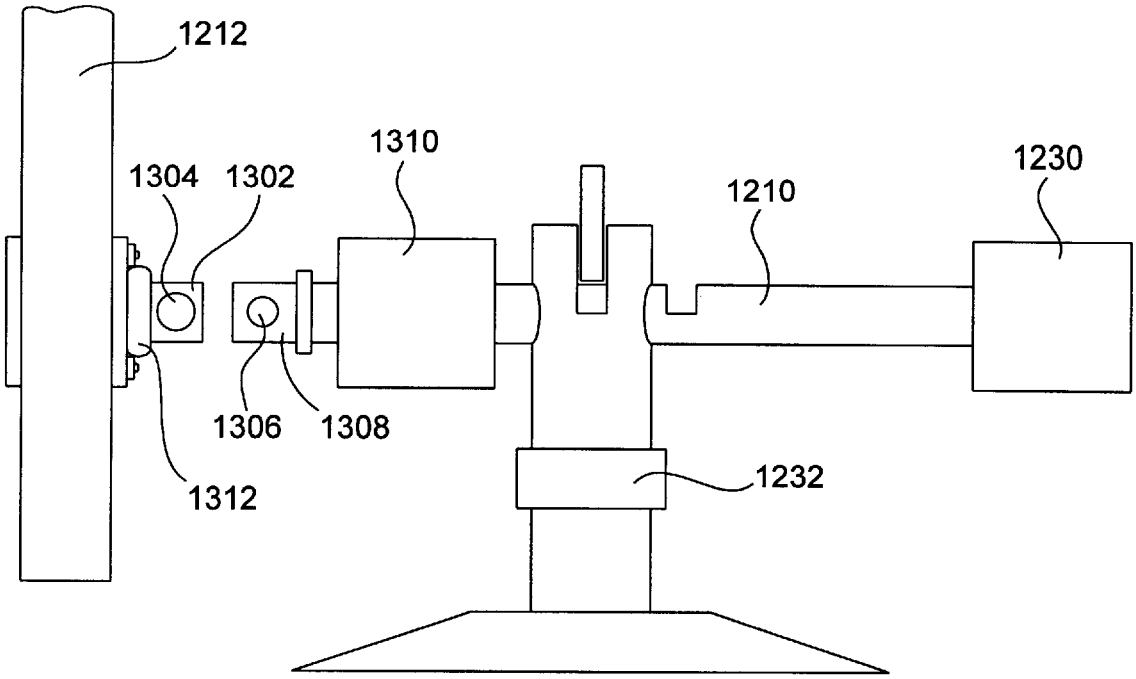
FIGS. 13A & 13B illustrate, in accordance with one embodiment of the present invention, an alternate embodiment of the multi-positional ADS lock that uses a nub, nub aperture and collar binding linkage.

In alternate embodiment, the door binding portion may include an extension that extends in the perpendicular direction away from the door mounting plate. As shown in FIG. 13A, an extension 1302 includes a nub aperture 1304 for mating with a binding nub 1306, which is located in a locking member binding end 1308 at one end of locking member 1210. Correspondingly, when binding nub 1306 is disposed inside nub aperture 1304, locking member 1210 is substantially coupled to door mounting plate 1208. The binding nub engages the aperture by rotating the body member about the base plate. Furthermore, because of the dynamics of the nub/aperture linkage, the extension may be configured to be movable so that the linkage will not pinch. Although FIG. 13A shows an engagement that is parallel to the floor, it should be noted that the engagement may also be made in a direction perpendicular to the floor, such as in embodiments where the locking member is pivotally coupled to the body member.

Figure 13B:
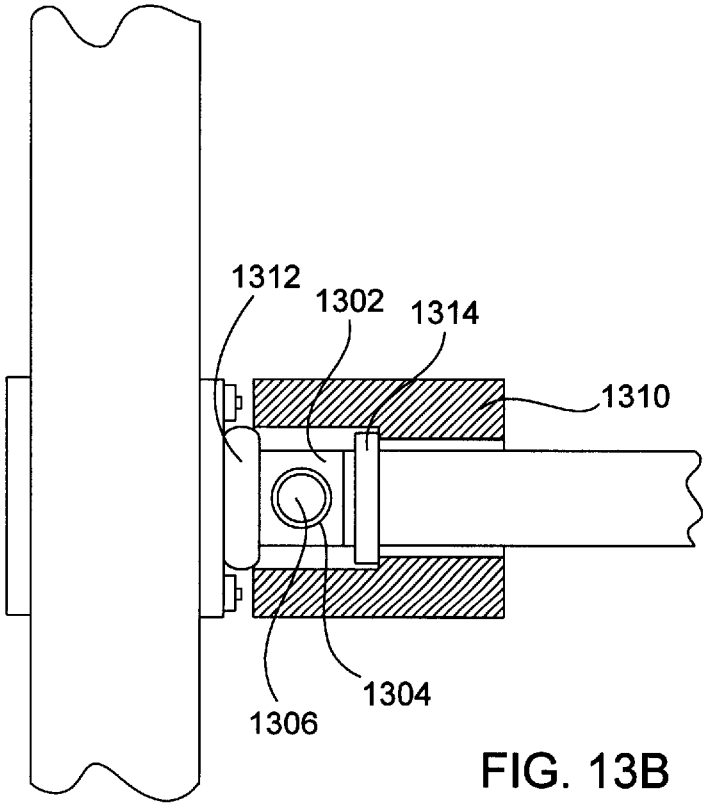

In some instances, the binding nub and nub aperture combination may need additional securement to prevent disengagement of the locking member and the door mounting plate. As shown in FIG. 13B, a collar 1310 is slidably coupled around locking member 1210. Collar 1310 is configured to slide over at least a portion of the nub/aperture linkage to prevent binding nub 1306 from disengaging from nub aperture 1304. Furthermore, locking member 1210 includes a collar stop 1314 for placing collar 1310 in the proper position over the nub/aperture linkage. Preferably, the collar is formed from a material that can withstand the forces of an unwanted intruder (e.g., steel or hard polymer such as plastic). Additionally, a gasket 1312 may be disposed around extension 1302 to stiffen the play between the binding nub and nub aperture. It should be noted that the collar is not a limitation and any means suitable for securing the binding nub and nub aperture combination may be used (i.e., twist locks, spring locks, screw locks, pin locks, etc).

Figure 14A:
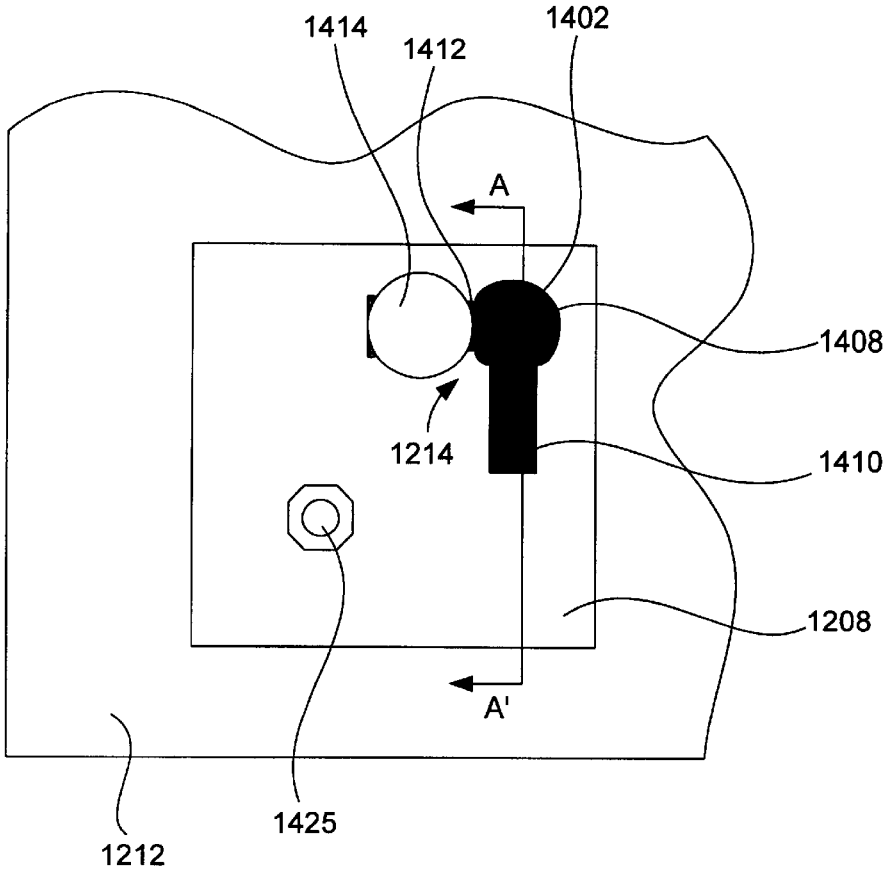
FIGS. 14A & 14B illustrate, in accordance with one embodiment of the present invention, an alternate embodiment of the multi-positional ADS lock that uses a mating head and notch binding linkage.
Figure 14B:
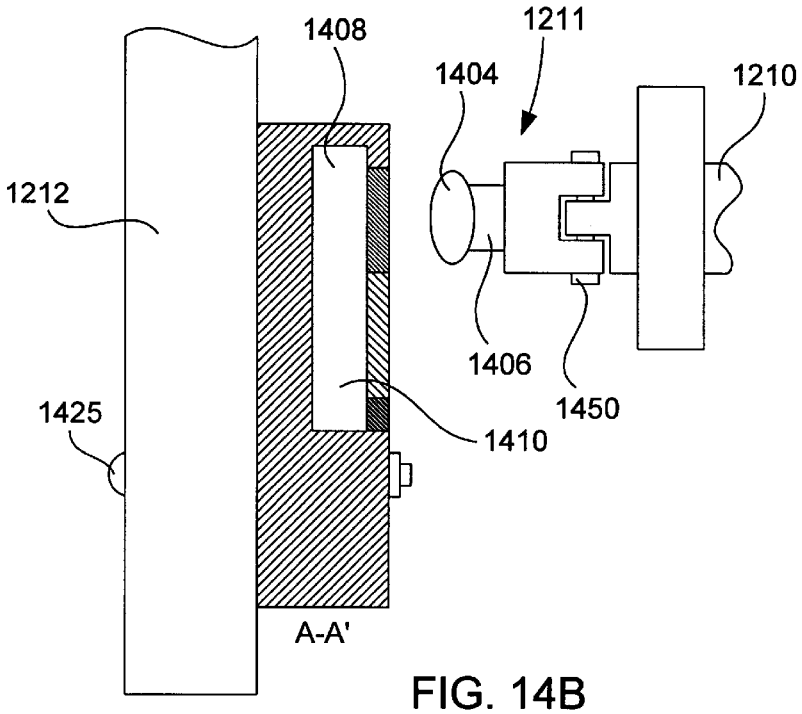

In another embodiment, the binding linkage (e.g., door binding portion and locking member binding end) may be configured as a notch guide and a mating head. Referring to FIGS. 14A–B, door binding portion 1214 includes a notch guide 1402 and locking member binding end 1211 includes a mating head 1404 and a mating neck 1406. Preferably, the cross sectional shape of mating head 1404 is larger than the cross sectional shape of mating neck 1406. Notch guide 1402 includes a mating opening 1408 and a notch 1410. Furthermore, notch 1410 extends away from mating opening 1408 in a direction perpendicular to the floor. Mating opening 1408 is configured to accept the cross sectional shape of mating head 1404 and notch 1408 is configured to accept the cross sectional shape of neck 1406.

Moreover, mating head 1404 may be disposed in mating opening 1408 and moved along notch 1410. Basically, the head is slidably coupled to the door binding portion when disposed in the notch. Because notch 1410 is smaller than mating head 1404, mating head 1410 is substantially bound in place in directions that are parallel to the floor (when in the notch). For this reason, a locking mechanism is provided to prevent movement of the mating head in a direction perpendicular to the floor (e.g., direction of notch). Preferably, door binding portion 1214 further includes a locking channel 1412 that is connected to mating opening 1408 for slidably coupling a slide lock 1414. Ideally, the locking channel direction is parallel to the floor. Correspondingly, when the mating head is disposed in the notch, the slide lock is moved to a locking position that is adjacent to the location of the mating head thereby locking the mating head in place. It should be noted that the locking mechanism is not limited to a slide lock and that any suitable locking mechanism that can hold the head in place may be used (e.g., spring biased pin). Similarly to the above mentioned methods, door mounting plate 1208 includes an aperture for accepting a bolt 1425 that is used to mount the door mounting plate to the door.

In an alternate embodiment, the locking member binding end is pivotally coupled to the locking member. As previously mentioned, a pivot point may be needed at the coupling between the locking member and the door mounting plate to eliminate pinching that typically occurs when the multi-positional ADS lock is moved to an open position (FIGS. 11B and 11C). Referring to FIG. 14B, a pivot pin 1450 is disposed in a portion of locking member binding end 1211 and a portion of locking member 1210 to pivotally couple locking member binding end 1211 to locking member 1210. Pivot pins are well known in the art, and for the sake of brevity will not be discussed in detail.

The multi-positional ADS lock further includes a stop arrangement configured to hold the locking member in at least one predetermined position relative to the body member. Correspondingly, the door is prevented from moving past a predefined door position (e.g., door shut, door partially open).

In one embodiment, the stop arrangement is configured as a slot and stop plate. Typically, the slot is a cut away portion of the locking member. The stop plate is configured to coincide with the geometry of the slot and abut to a portion of the body member (e.g., inner portion, outer portion) to prevent the locking member from sliding relative to the body member when the stop plate is disposed in the slot. Preferably, this stop arrangement is used in doors that are closed. In another embodiment of the present invention, the stop arrangement is configured as a blocking portion that is coupled to the locking member. The blocking portion is configured to abut to an outer portion of the body member to prevent the locking member from sliding relative to the body member. Preferably, this stop arrangement is used in doors that open away from the multi-positional lock.

Figure 15:
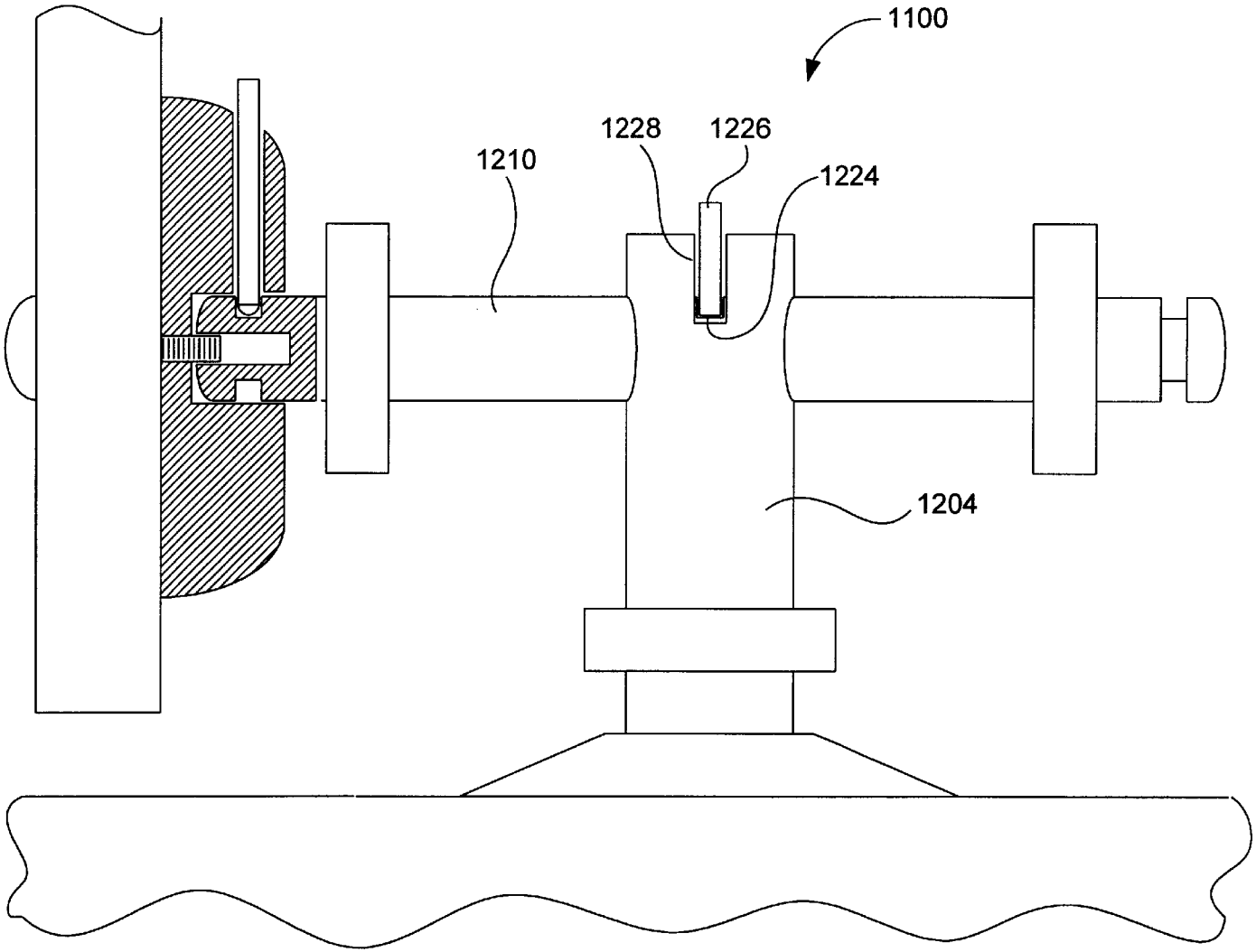
FIG. 15 depicts, in accordance with one embodiment of the present invention, a side view of the multi-positional ADS lock locking a door in the door shut position.

Referring to FIG. 15, a slot/stop plate arrangement is shown that prevents the locking member from sliding in either direction. Locking member 1210 includes a slot 1224 that is recessed along the perimeter of the locking member. Preferably, the depth of slot 1224 is configured to accept a portion of stop plate 1226. It should be noted that any portion of the locking member may be used to create the slot (e.g., a slot on one side of the locking member that may extend substantially to the center of the locking member). Correspondingly, stop plate 1226 is configured to fit into slot 1224. The stop plate may be formed from any shape so long as the shape coincides with a portion of the slot. Typically, the stop plate is formed from a material that can withstand the forces of an unwanted intruder (e.g., steel or hard polymer such as plastic).

Furthermore, body member 1204 includes a notch 1228 that is dimensioned to coincide with slot 1224. Notch 1228 is placed in an inner portion of body member 1204 and disposed at the end of the body member that is opposite the floor mounting end. When the slot and notch are aligned, slot plate 1226 may be disposed inside the slot/notch combination. Optionally, the slot plate may be coupled to the body member through a pivot point so that the plate may be easily positioned in the slot and notch. The pivot may be biased (e.g., spring) to automatically dispose the slot plate in the aligned slot/notch combination.

Still further, the slot may be disposed on the locking member in a plurality of locations. The slot may be configured in a location where the stop plate, rather than abutting to an interior portion of the body member (e.g., notch), abuts to the outer portion of the body member. Typically, this arrangement will only prevent locking member movement in one direction.

In a preferred embodiment of the present invention, the position of the slot on the locking member is predetermined as the door shut position (FIG. 11A). Generally, this position is used in doors that swing inward and/or outward or both. To implement this feature of the present invention, a multi-positional ADS lock user will close the door (e.g., door shut position) and secure the body member to the floor mounting plate. Once secured, the user will slide the locking member along the body member to engage the locking member binding end with the door binding portion of the door mounting plate (e.g., the binding pin engages the binding slot). At this point, the slot and notch should be aligned (e.g., predetermined for door shut position) and the user will place the stop plate into the slot/notch combination, thereby locking the door. If an intruder tries to pull or push the door open, the stop plate will abut to the body member, which will prevent the locking member from sliding. Because the locking member is coupled to the door mounting plate, the door will not move and the intruder will be prevented from gaining access.

Figure 16:
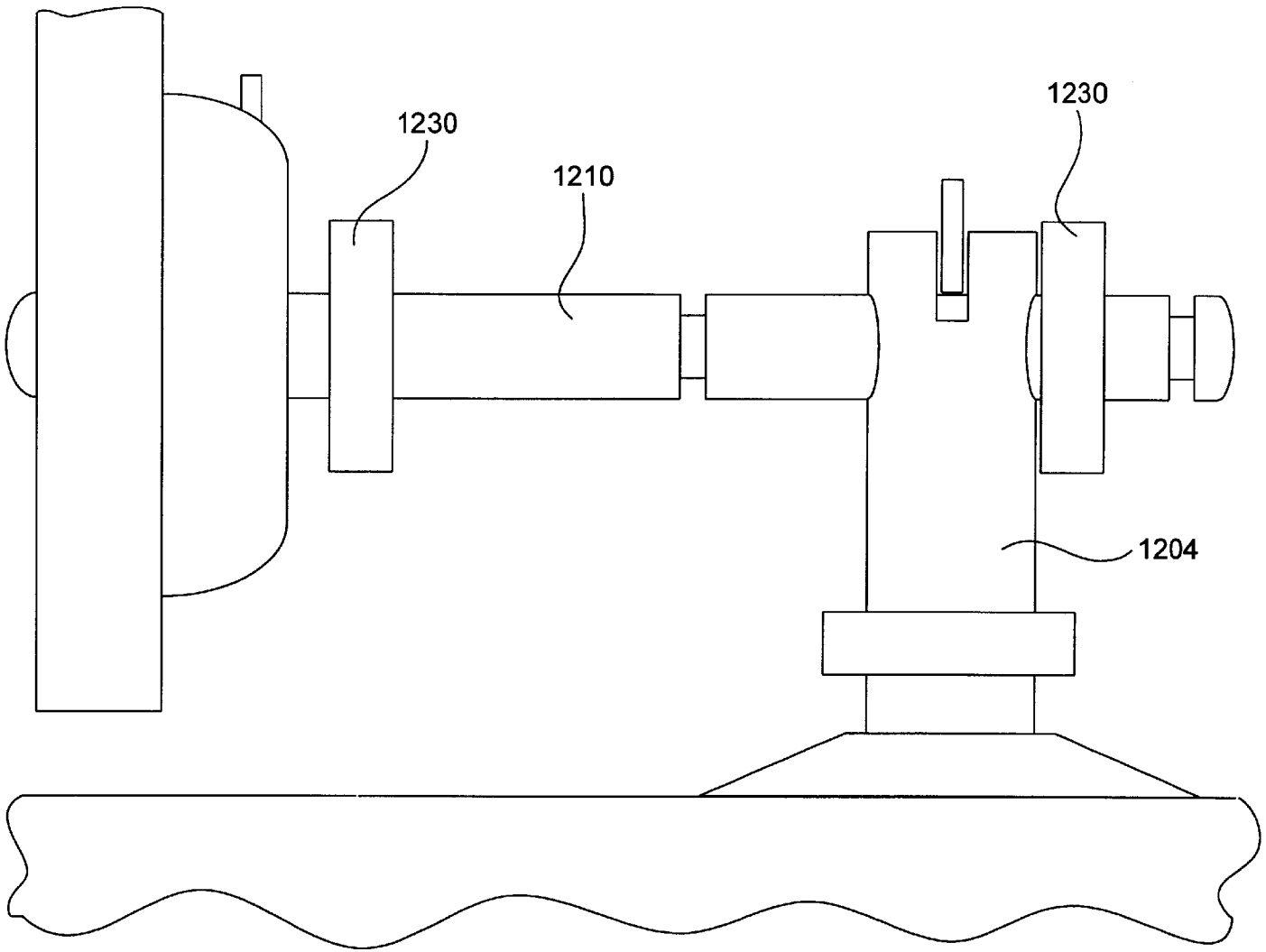
FIG. 16 shows, in accordance with one embodiment of the present invention, a side view of the multi-positional ADS lock preventing a door from moving in a direction away from the multi-positional ADS lock.

Referring to FIG. 16, a blocking portion stop arrangement is shown that prevents the locking member from sliding in one direction. In this embodiment, blocking portion 1230 is coupled to locking member 1210. Furthermore, blocking portion 1230 may be structurally coupled (i.e., set screw, weld, machined, etc) to the locking member at one predetermined position or be adjustable at several predetermined positions (i.e. a thread that coincides with a thread on the locking member, a pin that coincides with any number of apertures on the locking member, etc.).

Moreover, a portion of the outer perimeter of blocking portion 1230 is configured to extend away from the outer perimeter of the locking member. The blocking portion may take on any shape, and may include screws, pins and the like. Preferably, the blocking portion has a circular cross section that has an outer perimeter that is larger than the outer perimeter of the locking member. In this manner, blocking portion 1230 will stop the movement of the locking member when blocking portion 1230 comes into contact with the outer surface of the body member (as shown). Preferably, the blocking portion is formed from a material that can withstand the forces of an unwanted intruder (e.g., steel or hard polymer such as plastic). Optionally, a deformable gasket may be disposed around the locking member between the blocking portion and the body member to reduce wear that is developed by the contacting surfaces of the body member and blocking portion.

In a preferred embodiment of the present invention, the position of the blocking portion 1230 on the locking member is predetermined as the door partially open position away from the multi-positional ADS lock (FIG. 11B). Generally, this position is used in doors that swing outward to prevent a door from being pulled open by an intruder. Preferably, the blocking portion position allows the door to be opened about 2 inches to 3 inches. It should be noted that the stop arrangement used for the partially open position in a direction away from the ADS lock is not limited to the use of the blocking portion and that any suitable stop arrangements may be used (e.g., slot/slot plate).

To implement the previously described embodiment, a multi-positional ADS lock user will close the door (e.g., door shut position) and secure the body member to the floor mounting plate. Once secured, the user will slide the locking member to engage the locking member binding end with the door binding portion of the door mounting plate (e.g., the binding pin engages the binding slot). At this point, the door may be opened until the blocking portion abuts to the body member. Basically, the blocking portion limits how far the door may be opened. If an intruder tries to pull the door open, the blocking portion will abut to the body member thereby preventing the locking member from sliding. Because the locking member is coupled to the door mounting plate, the door will not move and the intruder will be prevented from gaining access.

Although the stop arrangements (FIGS. 14 and 15) are described as a slot/stop plate or a blocking portion, many other types of stopping arrangements may used that can prevent the lateral movement of the locking member (e.g., aperture and pin). Also, the present invention is not limited to only one slot or one blocking portion and that a multiplicity of slots and blocking portions may be used, especially if many stopping positions are desired.

Furthermore, the multi-positional ADS lock includes a blocking arrangement that is configured to prevent a door from opening in a direction towards the multi-positional ADS lock. In this embodiment, at least two blocking elements are configured to abut to a portion of the door when the locking member is parallel to the door to block the door from moving past the multi-positional ADS lock. It should be noted that the blocking portion that was previously described in the stop arrangement is also advantageously used as the blocking element in this embodiment, however, this is not a requirement.

Figure 17:
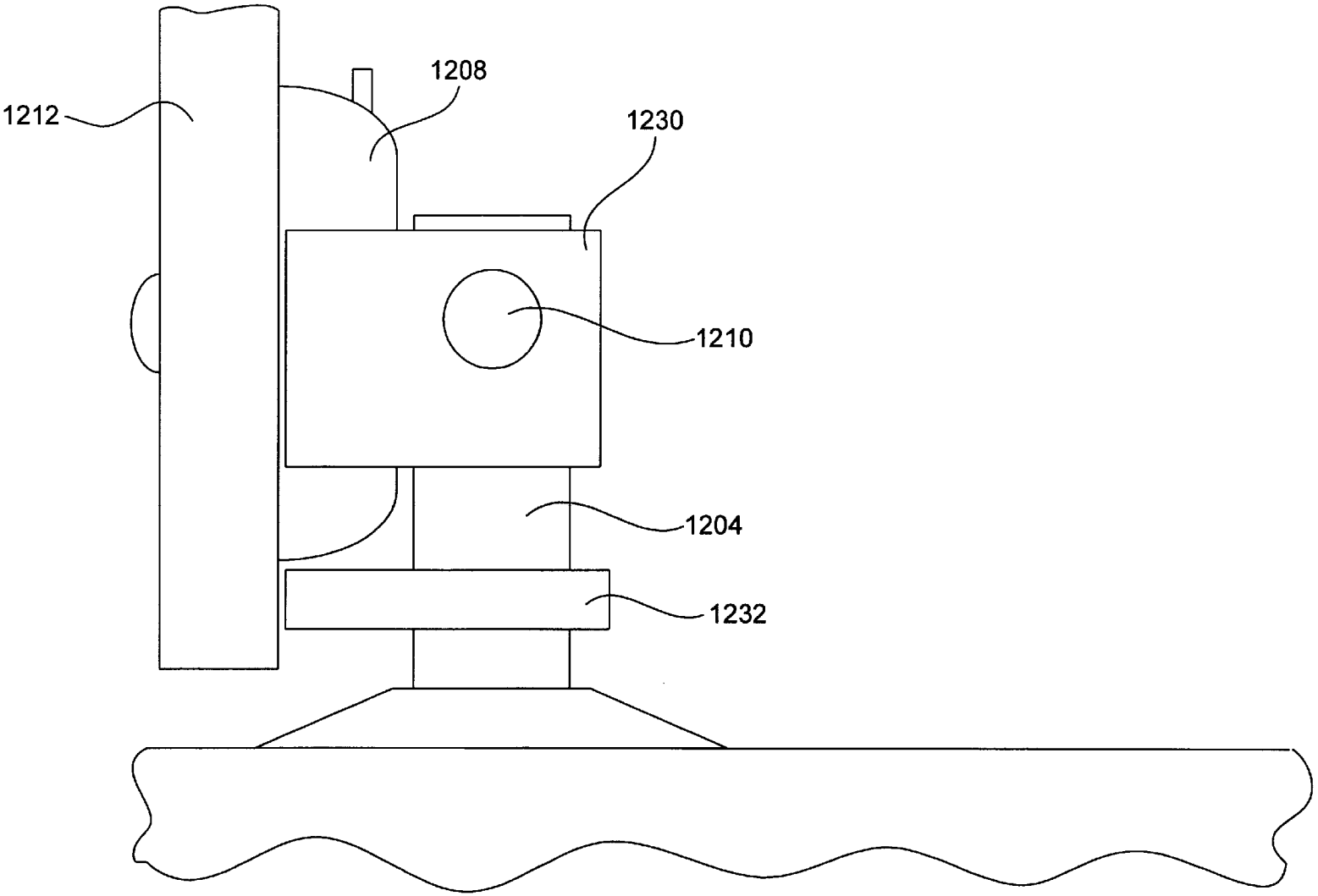
FIG. 17 depicts, in accordance with one embodiment of the present invention, a side view of the multi-positional ADS lock blocking a door from moving in a direction towards the multi-positional ADS lock.

To facilitate discussion of this aspect of the present invention, FIG. 17 shows a blocking element 1230 (same as blocking portion 1230) that is configured to abut to door 1212 when door 1212 is partially opened and when locking member 1210 is substantially parallel to door 1212. Although not shown, two substantially similar blocking elements are used to block the door. In this arrangement, the blocking elements are coupled to the locking member just inside the locking member binding ends (as shown in FIG. 12A). However, the blocking element position with respect to the locking member is typically determined by the blocking portion position of the previously described stop arrangement. Preferably, the blocking elements are dimensioned to prevent contact between the body member and the door mounting plate. The blocking elements may be formed from any geometrical shape (i.e., cylindrical, spherical, rectangular, cubical, triangular, polygonal, etc.) so long as they have a substantial outer periphery that contacts the door. Preferably, the blocking portions are formed from a material that can withstand the forces of an unwanted intruder (e.g., steel or hard polymer such as plastic). Alternatively, it may be desirable to include a soft deformable material (e.g., rubber or plastic) around the outer periphery of the blocking portions to prevent damage to the door.

Alternatively, a body member blocking element 1232 is coupled to the body member. Preferably, body member blocking element 1232 is configured similarly to the shape and dimensions of the previously described blocking elements. The body member blocking element is used in combination with the two blocking elements to create three contact points between the multi-positional ADS lock and the door. As is well known in the art, three points define a plane and therefore it is preferable to have three points of contact to prevent door movement. However, it should be noted that the multi-positional ADS lock is not limited to three contact points and any arrangement of contact points that prevent the movement of a door may be used.

In a preferred embodiment of the present invention, the location of the multi-positional ADS lock on the floor is predetermined as the door partially open position towards the multi-positional ADS lock (FIG. 11D). Generally, this position is used in doors that swing inward to prevent a door from being pushed open by an intruder. Preferably, the multi-positional ADS lock position allows the door to be opened about 2 inches to 3 inches. Alternatively, it should be known that this position may be achieved using the implementation as shown in FIG. 11C.

To implement the previously described embodiment, a multi-positional ADS lock user will close the door (e.g., door shut position) and secure the body member to the floor mounting plate. Once secured, the user will rotate the body member so that the locking member is parallel to the door. The user will then lock the locking member in place using the stop plate. At this point, the door may be opened until the two blocking portions and the body member blocking portion abut to the door. Basically, the position of the ADS lock with respect to the door limits how far the door may be opened. If an intruder tries to push the door open, the blocking portion will abut to the door thereby preventing the door from opening any further. Because the body member is coupled to the floor mounting plate, the door will not move and the intruder will be prevented from gaining access.

In an alternate embodiment, the collar as shown in 13A&B is substantially similar in dimension as blocking portion 1230, so that when body member 1204 is rotated into the blocking position the door abuts to the outer periphery of collar 1310 and blocking portions 1230 thereby preventing any further inward movement by door 1212. However, the extension of the door binding portion may impede the blocking structure of the multi-positional ADS lock in this embodiment. Therefore, the door binding portion may be configured to be movable. Several examples include: removing the door binding portion from the door mounting plate, sliding the door mounting plate to a position that will not impede, or placing the door binding portion on a pivot. In the pivot example, the extension is moved to a position that is substantially flush with the door mounting plate, thereby moving it out of the way.

Accordingly, the present invention offers numerous advantages over existing door locking mechanisms. Advantageously, the multi-positional ADS lock is placed within the confines of the interior part of the door. In this manner, an intruder cannot disengage the locking mechanism to gain entry, or even attempt to cut through, although this would be difficult even if seen by the intruder. Additionally, because the lock is placed behind the door, the multi-positional ADS lock user does not have to offend non-intruders with a showing of the lock.

Furthermore, the floor is more secure than a door frame, which under extreme force of an intruder may buckle or break. Typically, they are screwed into the door jamb. If an intruder uses enough force the screws holding the lock may be stripped from the door jamb or the doorjamb itself may be disengaged from the wall. Moreover, the multi-positional ADS lock provides a user, multiple positions for preventing a door from being moved. Simply put, one design may be used on all swinging doors, whether they open in or out. Furthermore, the slot and stop plate combination used for the door shut position provides easy control for accessing other stop positions (e.g., the user only has to manipulate the stop plate). Also, the multi-positional ADS lock cannot be picked, like some dead bolt lock arrangements. Additionally, because of the advantageous design, the invention is removable, thereby enabling aesthetic choices for a user.

Although only a few embodiments of the present invention have been described, it should be understood that the present invention may be embodied in many other specific forms without departing from the spirit or scope of the invention. In particular, although only two configurations of the blocking member (e.g., ADS lock) have been disclosed, it should be clear that many other configurations may be embodied without departing from the spirit or the scope of the invention. Some possible configurations include, but are not limited to, configurations in which the blocking member is Y-shaped and configurations in which the blocking member is simply a single bar, e.g., without lock arm 604, or a plate.

Furthermore, it may be desirable to alter the combination of the door mounting plate, locking member and body member to form a new configuration that performs relatively the same function. In one such embodiment, one end of the locking member is permanently coupled to the door mounting plate and the other end includes a locking member binding end. Furthermore, the body member is configured with a body binding portion that is arranged to temporarily couple the locking member binding end to the body member. When the body binding portion and the locking member binding end are engaged, the door is prevented from moving past one of the predefined door positions previously described. In one embodiment, the locking member is pivotally coupled to the door mounting plate and therefore engages the body member by rotating about the pivot point (e.g., top to bottom or side to side).

Additionally, although the multi-positional ADS lock has been primarily discussed as a rigid member, it should be noted that the locking member may be a cable. In view of this, the locking member binding end may be a loop of cable that engages a lip at the corresponding binding portion or may be something similar (although modified) to what has been previously discussed (e.g., slot/pin, nub/nub aperture/collar). Also, the locking member may have multiple pivots or a telescoping arrangement in order to movably couple to the door.

In some embodiments of the present invention, it may be desirable to incorporate the use of roller bearings with the blocking or locking member to extend the life of the ADS lock or the multi-positional ADS lock. Similarly, the use of a bearing surface, as for example a coating of Teflon™, may be implemented in place of an actual mechanical bearing.

While a base plate or a floor mounting plate which is arranged not to penetrate a floor may be functionally attached to the floor through the use of fastening devices such as screws, it should be appreciated that a variety of other mechanisms may be used to secure the base plate to the floor. By way of example, adhesives may be used to secure the base plate to the floor without departing from the spirit or the scope of the present invention. Alternatively, magnetic mechanisms may also be used to effectively attach the base plate to the floor.

A base plate which is arranged to support the post or body member of an ADS lock above the surface of a floor has generally been described has having a substantially circular shape or, more specifically, a substantially circular footprint. However, it should be understood that the shape of the footprint of the base plate may be widely varied. For instance, alternate shapes may include, but are not limited to, elliptical, rectangular, and polygonal shapes. Similarly, the shape of the protrusion and the channel of a base plate may also vary, and are not necessarily substantially circular.

Although a groove, or channel, formed around the protrusion of a base plate that supports a post has been described as being "continuous," e.g., uniform and smooth, it should be appreciated that in some embodiments, the groove may be discontinuous. In other words, the groove itself may include protrusions that engage corresponding cavities of a post in order to further secure the ADS lock.

While a non-intrusive base plate such as base plate 700 of FIG. 7 has been described as being suitable for use with an ADS lock, a non-intrusive base plate may be used with a variety of different door security locks without departing from the spirit or the scope of the present invention. In some cases, modifications may be made to the locks themselves to enable the locks to be supported on such a base plate. Therefore, the present examples are to be considered as illustrative and not restrictive, and the invention is not to be limited to the details given herein, but may be modified within the scope of the appended claims.

What is claimed is:

1. An apparatus for holding a door relative to a floor, comprising;

a door mounting plate adapted to be fixed to the door;

a floor mounting plate adapted to be mounted on the floor, and including a recess; and a locking assembly that is attached and removed from the floor mounting plate and door mounting plate as a unit, and including a rigid body member adapted to be secured to the floor mounting plate and a locking member adapted to be secured to the door mounting plate, wherein the locking member and the door mounting plate have a cooperating connection means for allowing removable connection from the door mounting plate, and wherein the rigid body member is arranged for placement in the recess of the floor mounting plate so as to provide a secure and removable engagement, and wherein the rigid body member and the locking member have a linear slide means and a stop abutment means for defining a plurality of secure predetermined positions of the door when the assembly is connected to the door mounting plate and the floor mounting plate.

2. The apparatus of claim 1 wherein the locking member is movably coupled to the body member.

3. The apparatus of claim 2 wherein the locking member is slidably coupled to the body member.

4. The apparatus of claim 1 wherein the body member is adapted to be positioned inside a cavity in the floor.

5. The apparatus of claim 1 wherein the body member is adapted to rotate relative to the floor.

6. The apparatus of claim 5 wherein the engagement of the binding end to the door binding portion is implemented by rotating the body member.

7. An apparatus for preventing a door from being forcibly opened relative to a floor from either a first predefined position or a second predefined position, the door being opened further in the second predefined position than in the first predefined position, said apparatus comprising:

a door mounting plate adapted to be fixed to the door, the door mounting plate having a door binding portion;

a floor mounting plate adapted to be secured to the floor, the floor mounting plate having a recess;

a body member having a through hole and an end that is adapted to be inserted into the recess of the floor mounting plate such that the body member is secured to the floor by inserting the body member in the recess of the floor mounting plate;

the body member being rotatably positionable relative to the floor mounting plate; and a longitudinal locking member having a binding end that is adapted to be engageable with the binding portion of the door mounting plate in order to securely attach the locking member to the door mounting plate, the locking member being dimensioned for sliding receipt through the through-hole of the body member, the locking member being provided with longitudinally spaced abutment stops that prevent sliding of the locking member through the through-hole, the abutment stops being configured to correspond to at least the first predefined position and the second predefined position.

8. The apparatus of claim 7 wherein the locking member includes at least a pair of blocking members, the blocking members being disposed proximate each end of the locking member, the blocking members extending perpendicularly away from the longitudinal axis of the locking member, the blocking members being configured for blocking movement of the door when the locking member is positioned substantially parallel to the door.

9. An apparatus for holding a swinging pivot action type door in a closed or partially open position relative to a floor, comprising:

a door mounting plate adapted to be fixed to the door, the door mounting plate having a door binding portion;

a rigid body member adapted to be secured to the floor;

a locking member slidably coupled to the body member and having a binding end adapted to be engageable with the binding portion of the door mounting plate in order to securely attach the locking member to the door mounting plate, the locking member including a slot that coincides with a predetermined position relative to the body member; and a stop arrangement for holding the locking member in the predetermined position relative to the body member, wherein the holding prevents the door from moving past a predefined door position when the binding end of the locking member is securely attached to the binding portion of the door mounting plate, and wherein the stop arrangement includes a stop plate that is adapted to be disposed in the slot and adapted for abutment with the body member when the plate is disposed in the slot such that the locking member prevented from moving relative to the body member.

10. The apparatus of claim 9 further including a floor mounting plate adapted to be fixed to the floor, the floor mounting plate including a recess for receiving the body member such that the body member can be secured to the floor by positioning the body member in the recess of the floor mounting plate.

11. The apparatus of claim 10 wherein the floor mounting plate further includes a protrusion disposed within the recess.

12. The apparatus of claim 10 wherein the floor mounting plate is adapted to be positioned inside the swinging path of the door.

13. The apparatus of claim 9 wherein the door mounting plate has a door mounting surface for contacting the door, and wherein the door binding portion extends perpendicularly from the door mounting surface, the binding portion having a receiving portion adapted to receive the binding end of the locking member, the binding portion having an aperture and a pin that is slidably received in the aperture for engaging the binding end of the locking member in order to securely attach the locking member to the door mounting plate.

14. The apparatus of claim 13, wherein the binding end of the locking member includes a slot for receiving the pin.

15. The apparatus of claim 14, wherein the pin is biased towards the receiving portion of the door binding portion such that the pin slides into the slot to attach the locking member to the door mounting plate when the binding end of the locking member is received by the binding portion of the door mounting plate.

16. The apparatus of claim 9 wherein the stop arrangement has a plurality of predetermined positions relative to the body member.

17. The apparatus of claim 9 wherein the stop arrangement includes a blocking portion coupled to the locking member at the predetermined position, the blocking portion being adapted for abutment with the body member such that the locking member is prevented from sliding past the predetermined position when the blocking portion abuts the body member.

18. The apparatus of claim 17 wherein said body member is rotatably coupled to the floor.

19. The apparatus of claim 18 wherein the body member is positioned on the floor inside the swinging path of the door and herein the blocking portion is arranged to prevent the door from opening past a partially open position towards the body member when the door is moved adjacent to the blocking portion.

20. The apparatus of claim 9 wherein the predefined door position is a door closed position.

21. The apparatus of claim 9 wherein the predefined door position is a partially door open position that is in a direction away from the body member.

22. The apparatus of claim 9 wherein the predefined door position is a partially door open position that is in a direction towards the body member.

* * * * *